United States Patent [19]

Ady

[11] Patent Number: 4,764,654

[45] Date of Patent: Aug. 16, 1988

[54] PROCESS AND APPARATUS FOR TREATING ELECTRICALLY CONDUCTIVE MATRICES AND PRODUCTS PRODUCED BY THE PROCESS

[75] Inventor: Joseph Ady, Islington, Canada

[73] Assignee: Metafuse Limited, Ontario, Canada

[21] Appl. No.: 694,750

[22] Filed: Jan. 25, 1985

Related U.S. Application Data

[63] Continuation of Ser. No. 319,678, Nov. 9, 1981, abandoned, which is a continuation-in-part of Ser. No. 224,762, Jan. 13, 1981, abandoned.

[51] Int. Cl.[4] ..... B23P 17/00

[52] U.S. Cl. ..... 219/76.13; 219/78.02

[58] Field of Search ..... 219/76.13, 78.02, 137 R

[56] References Cited

U.S. PATENT DOCUMENTS

| | | | |
|---|---|---|---|
| 3,098,150 | 7/1963 | Inoue | 219/76.13 |
| 3,200,234 | 8/1965 | Crawford | 219/76.13 |
| 3,277,266 | 10/1966 | Blaszkowski | 219/76.13 |
| 3,741,426 | 6/1973 | Inoue | 219/76.13 |
| 4,346,281 | 8/1982 | Inoue | 219/76.13 |
| 4,405,851 | 9/1983 | Sheldon | 219/76.13 |

*Primary Examiner*—Clifford C. Shaw

*Attorney, Agent, or Firm*—Cushman, Darby & Cushman

[57] ABSTRACT

A process for the fusion of a second conductive element into the matrix of a first conductive element is provided in which the second element either as a solid or as a dissociable solution is placed in contact with the first conductive element and subjected to an interrupted electrical signal of a predetermined frequency.

7 Claims, 38 Drawing Sheets

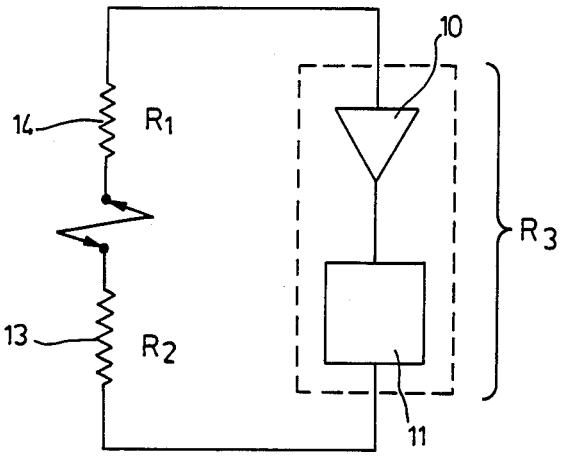
FIG. 3.
FIG. 4.
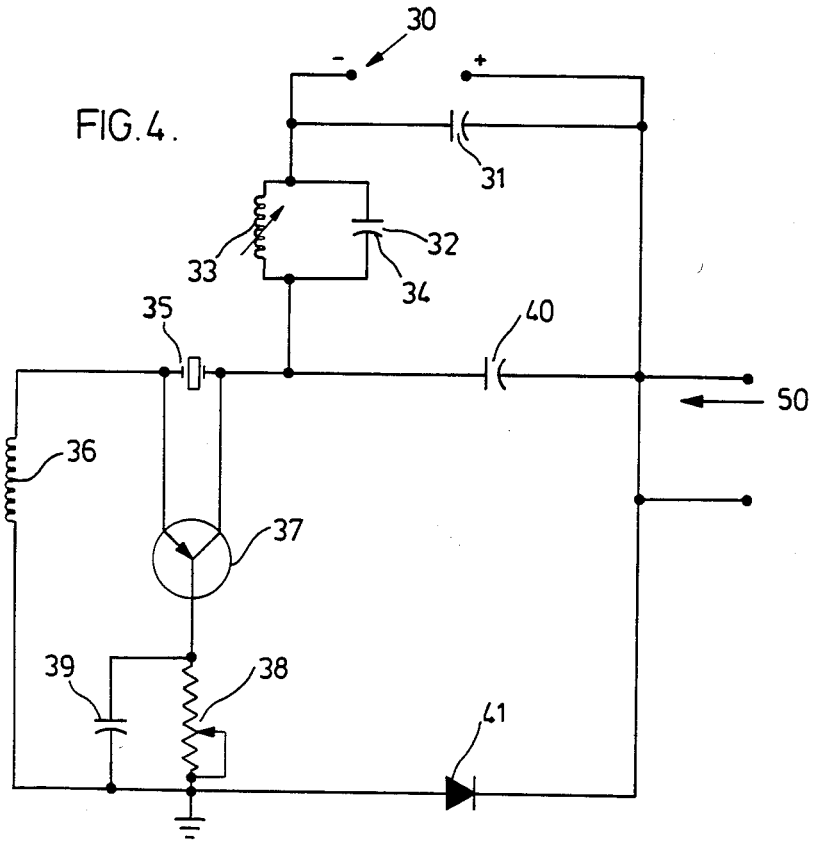

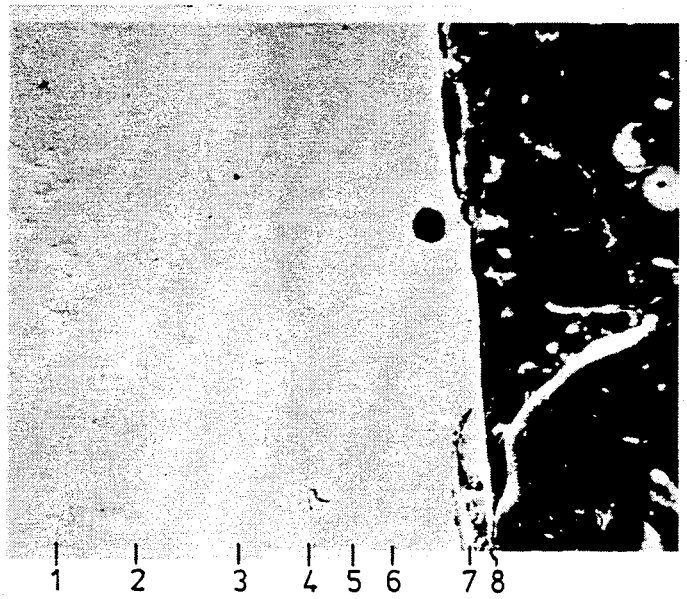
FIG. 5.
FIG. 6.
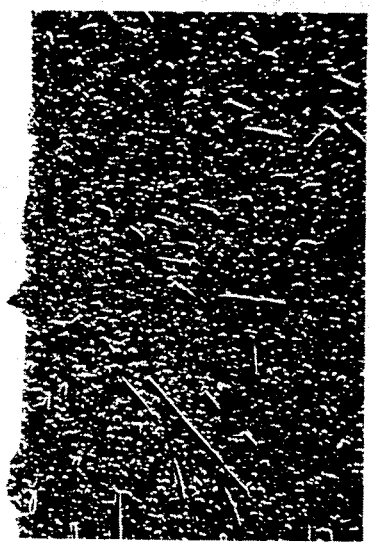

Fe
Fe

Fe

Fe

Fe

Fe
Fe

Ti
Fe

Ti
Fe

Ti
Mn
Fe

Ti

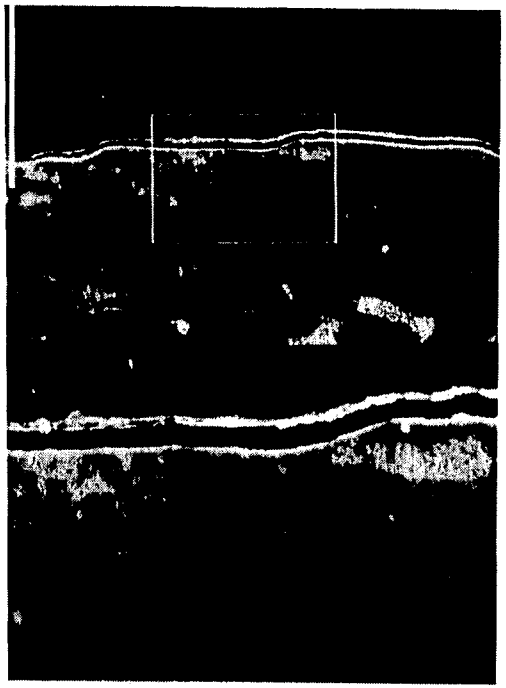
FIG. 18.
FIG. 18A.
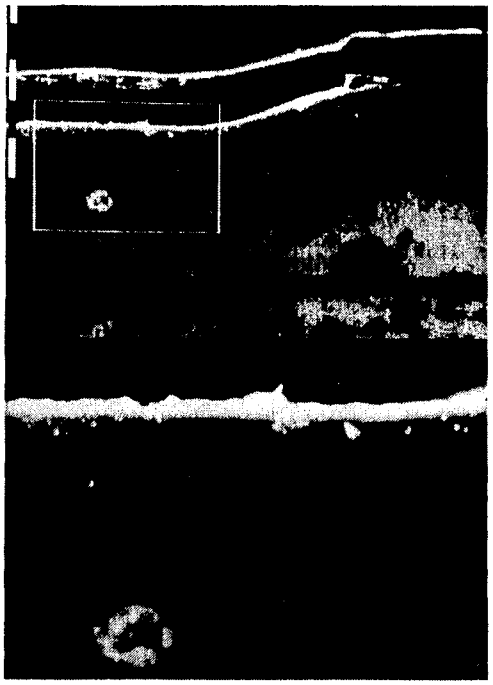

FIG.19.
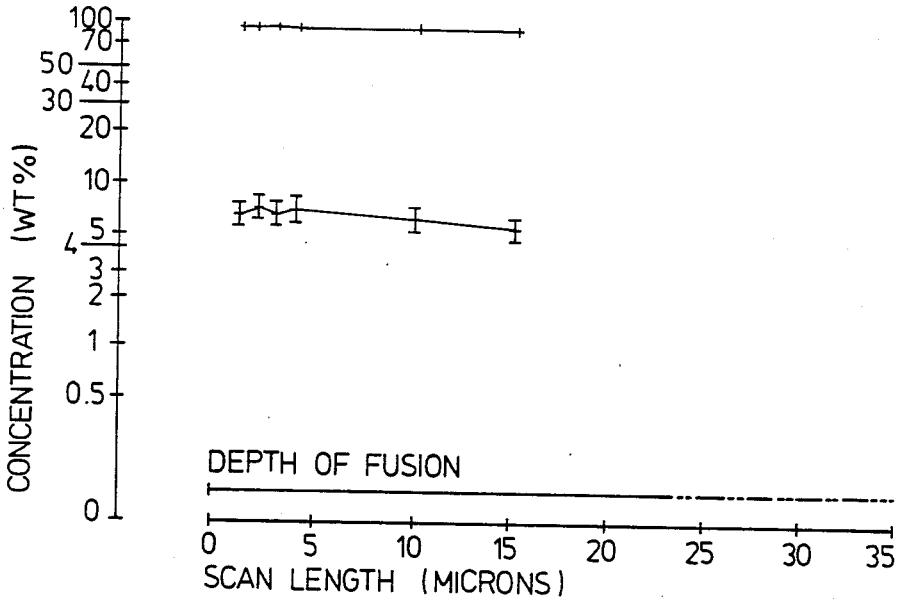
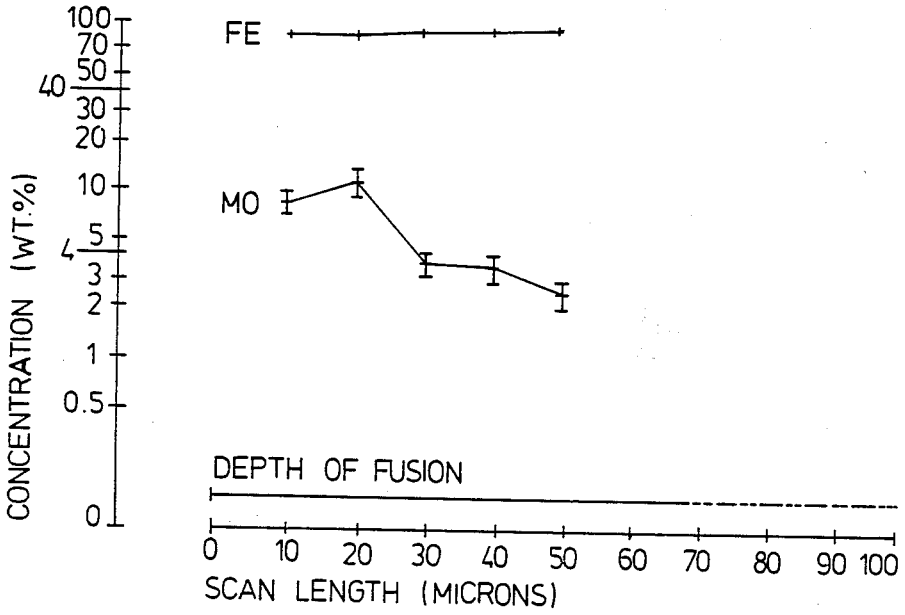
FIG.19A.

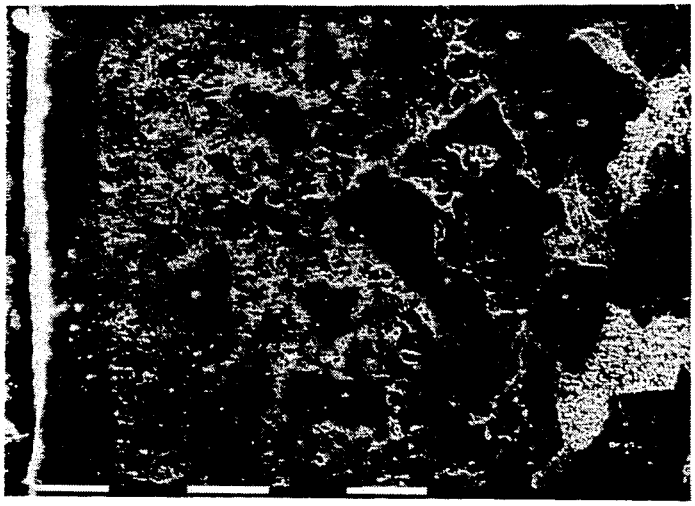
FIG. 20.
FIG. 21.
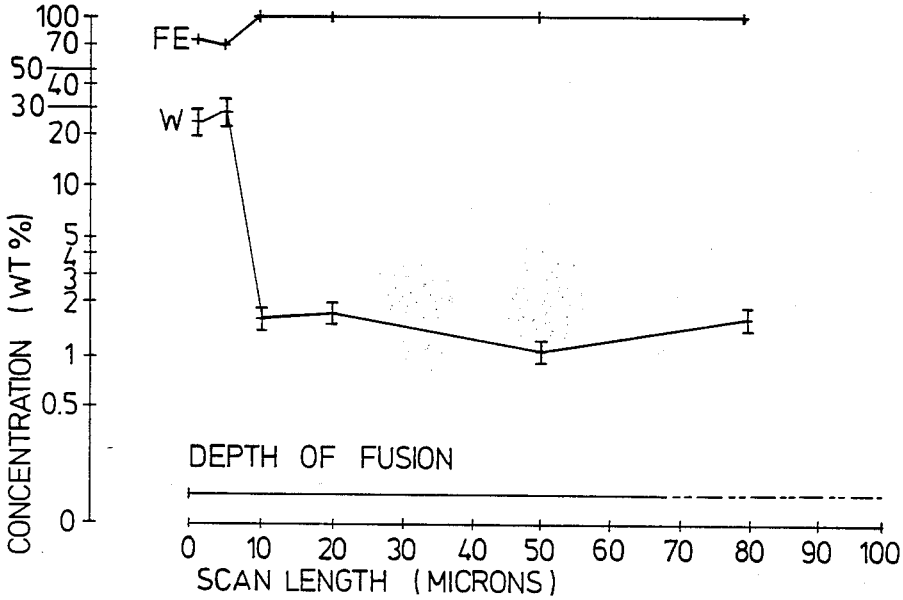

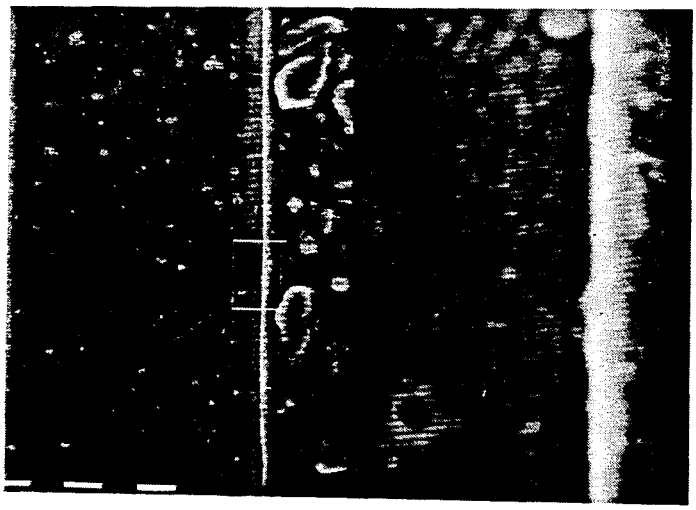
FIG. 22.
FIG. 23.
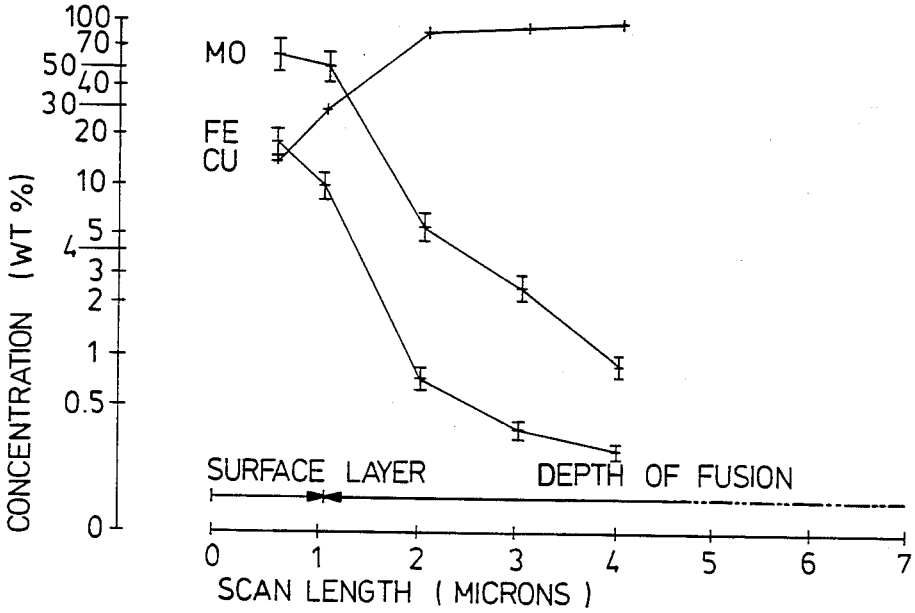

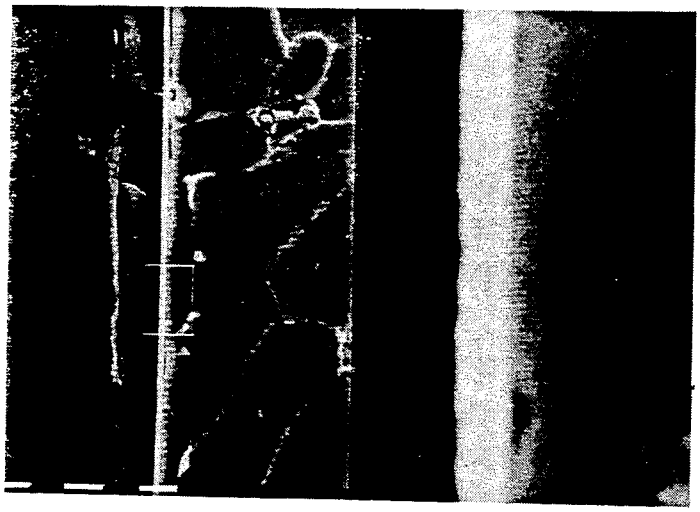
FIG. 24.
FIG. 25.
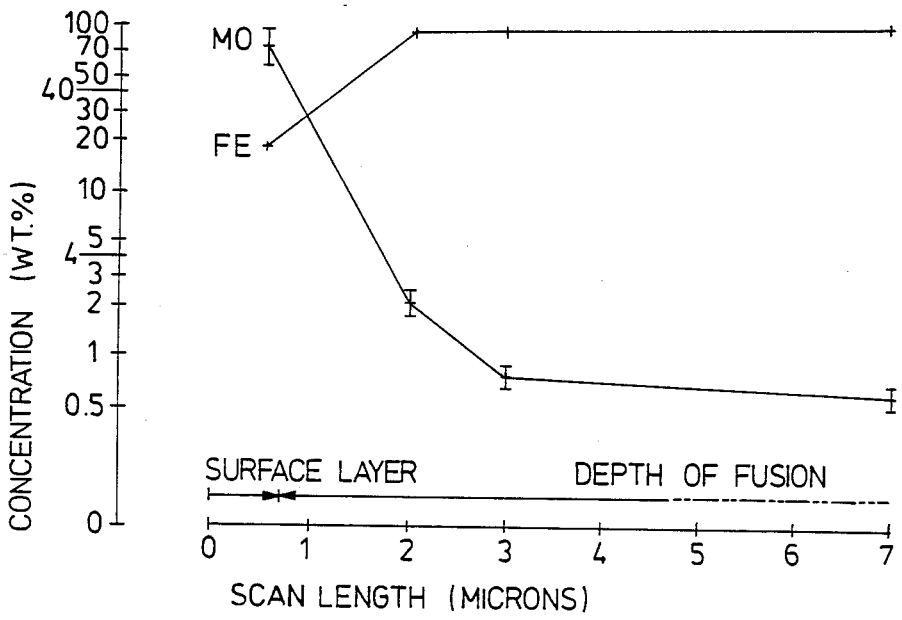

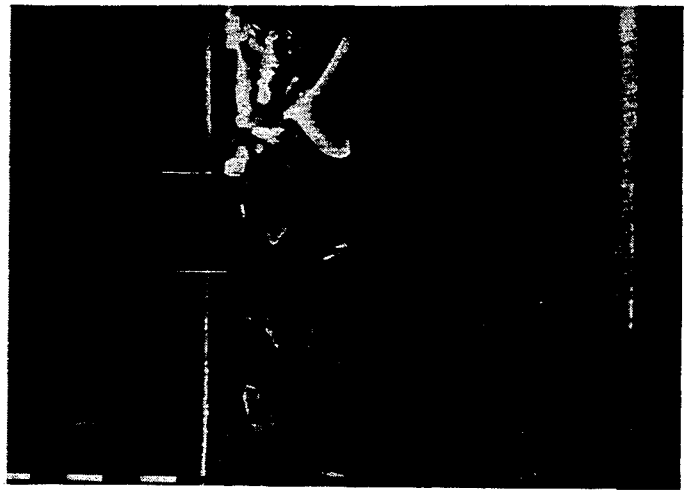
FIG. 26.
FIG. 27.
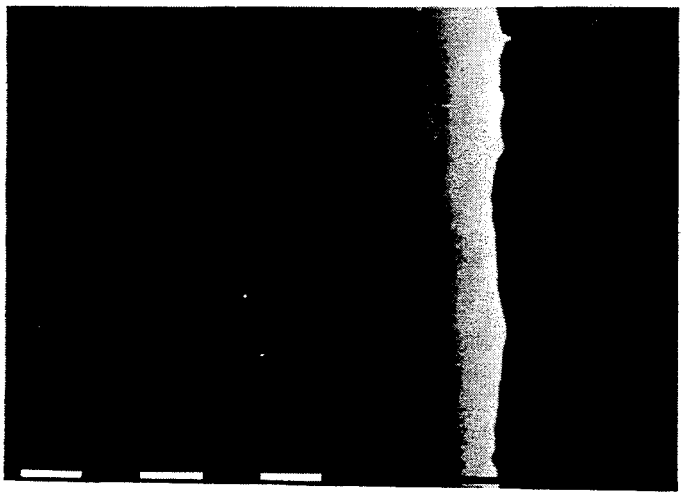

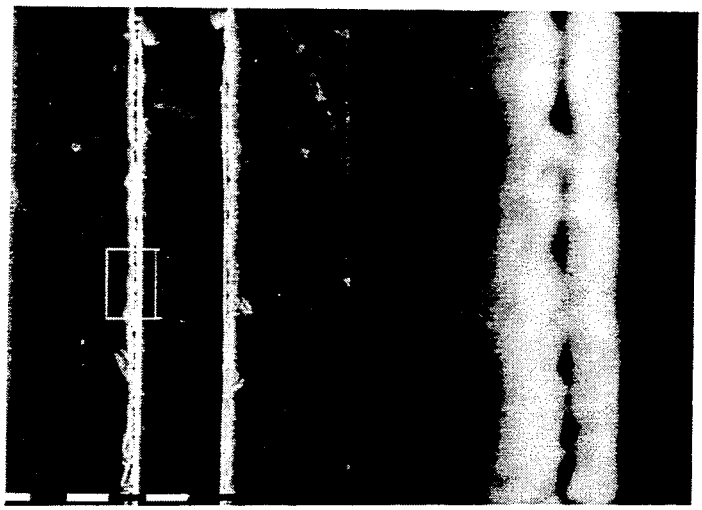
FIG. 29.
FIG. 30.
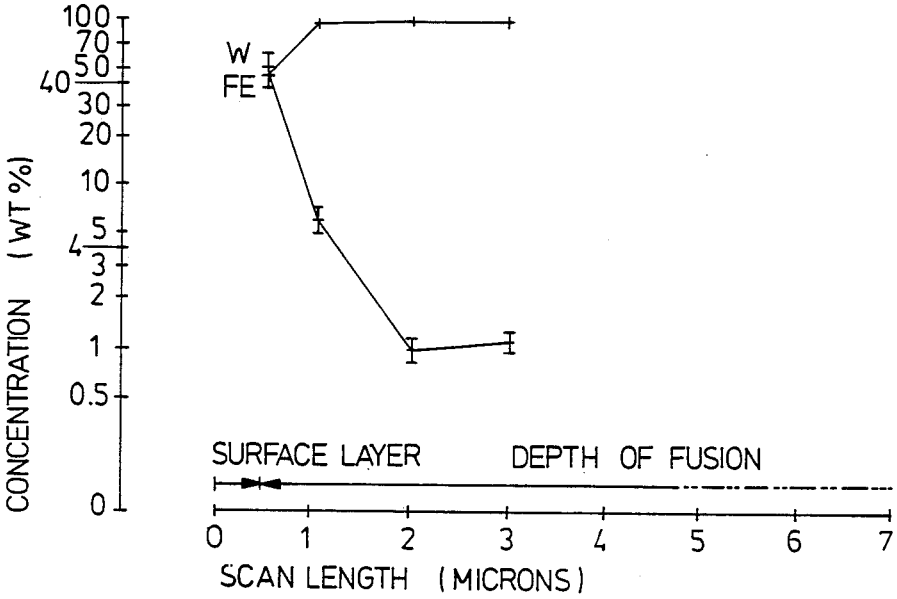

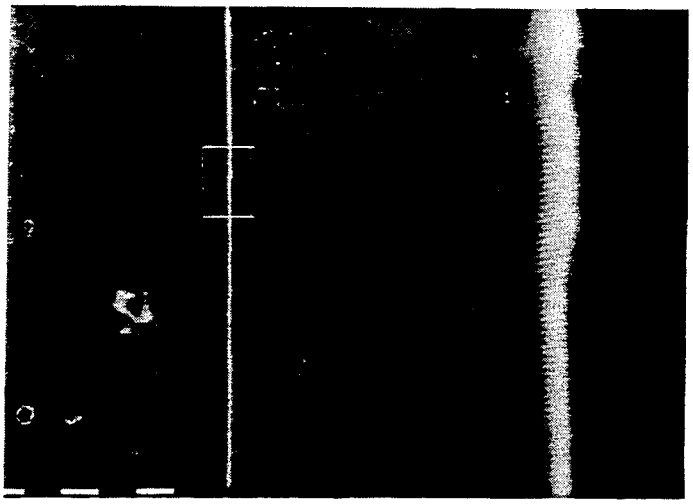
FIG. 31.
FIG. 32.
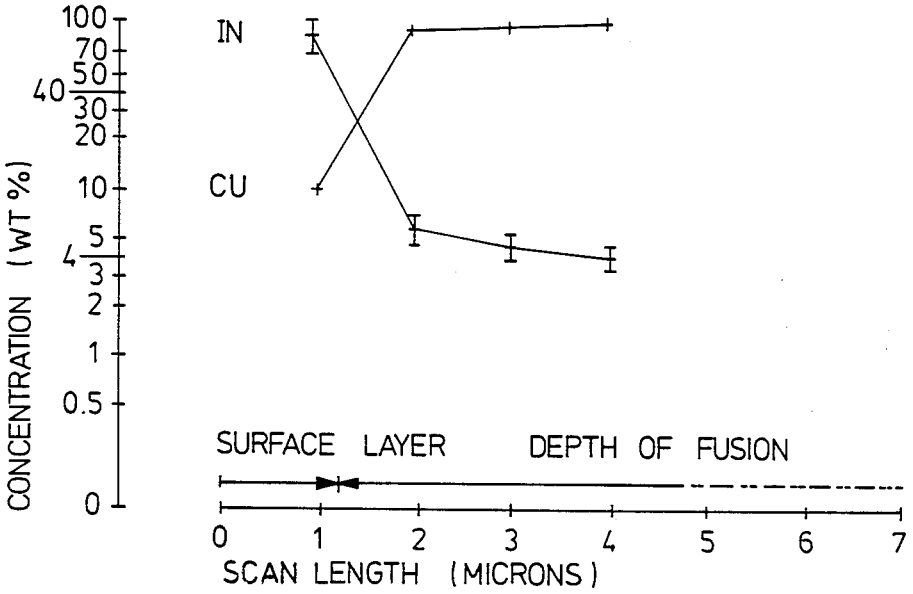

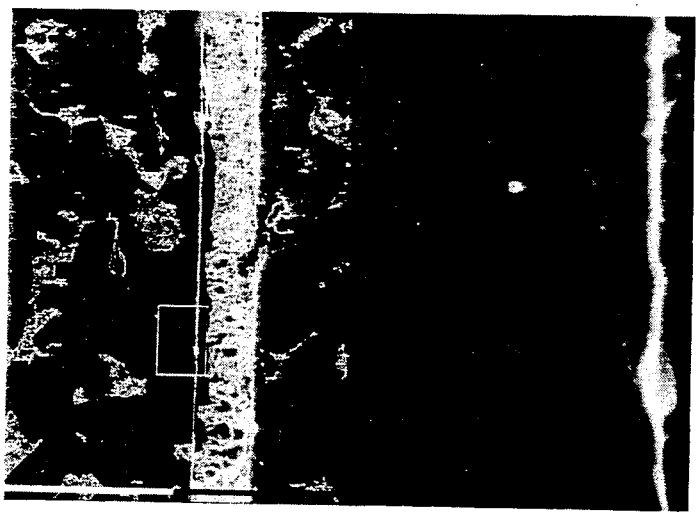
FIG. 33.
FIG. 34.
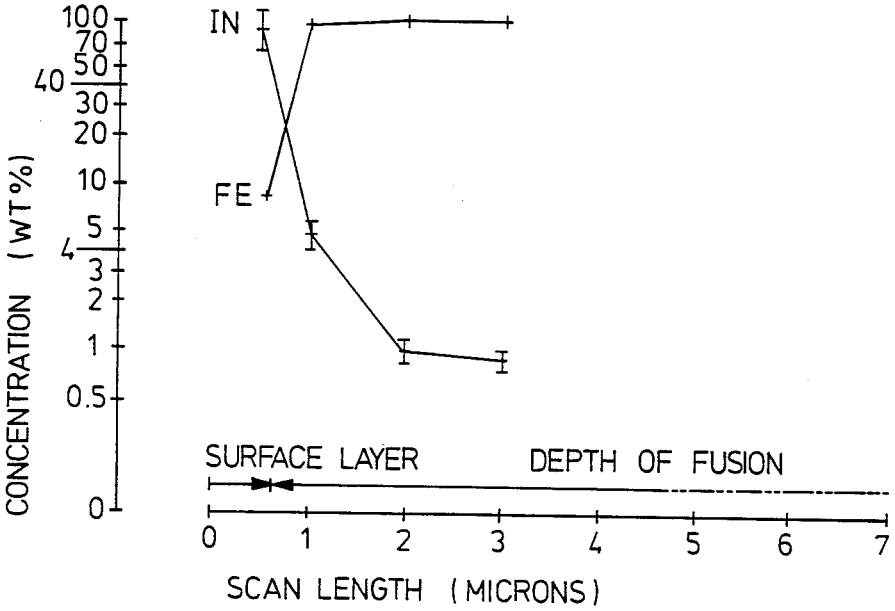

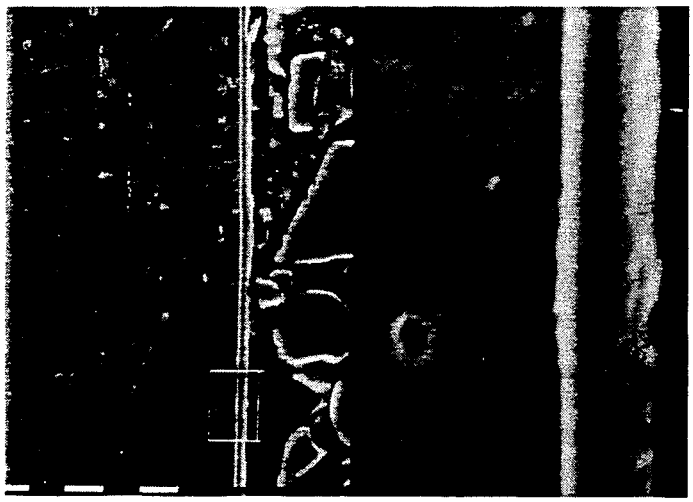
FIG. 35.
FIG. 36.
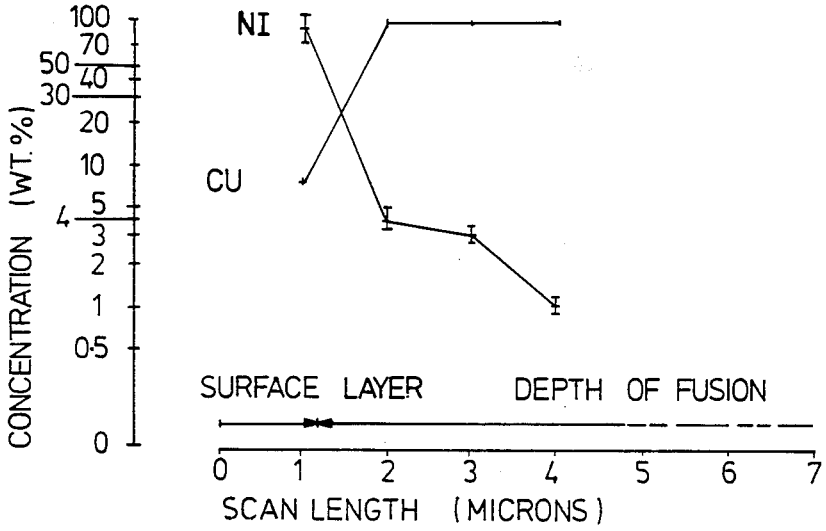

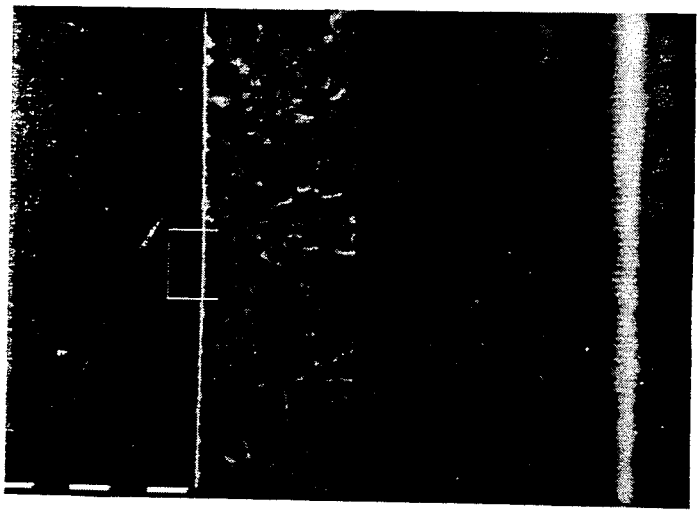
FIG. 37
FIG. 38
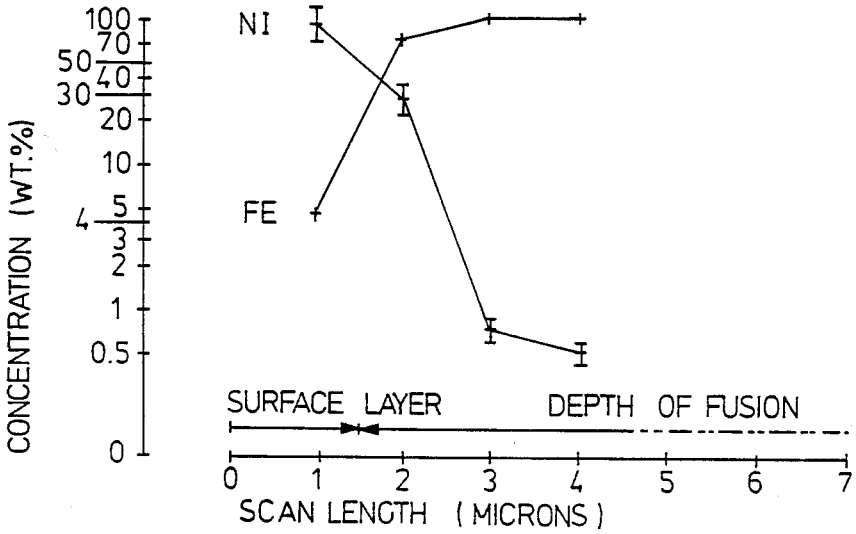

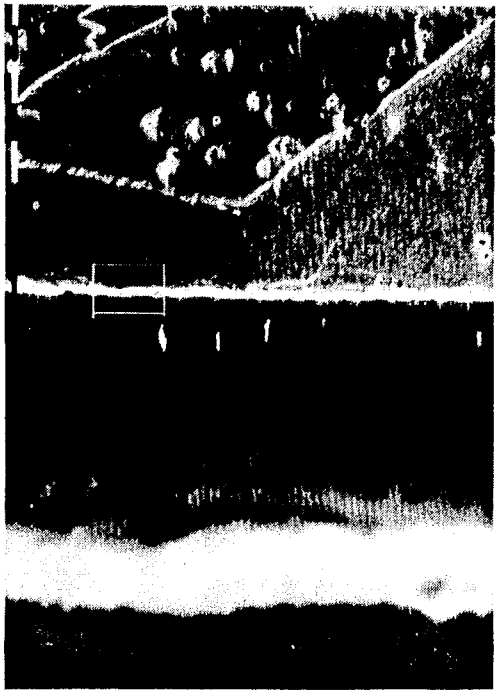
FIG. 39.
FIG. 40.
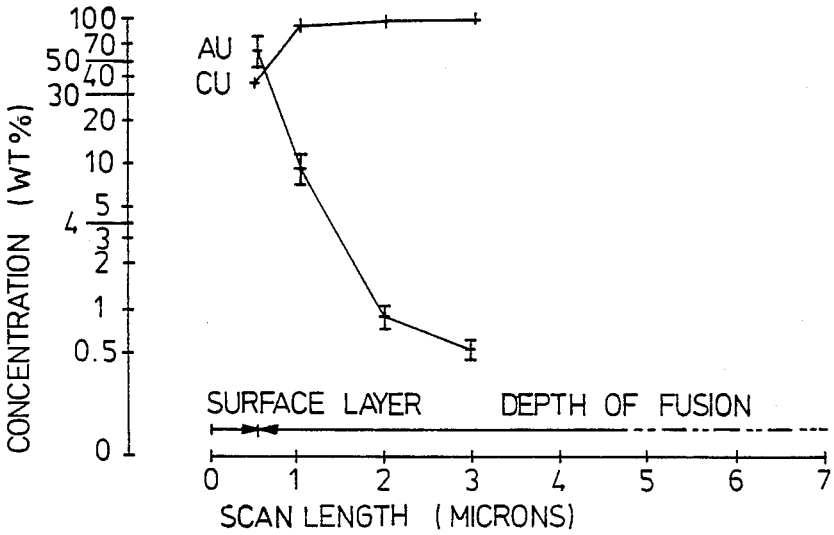

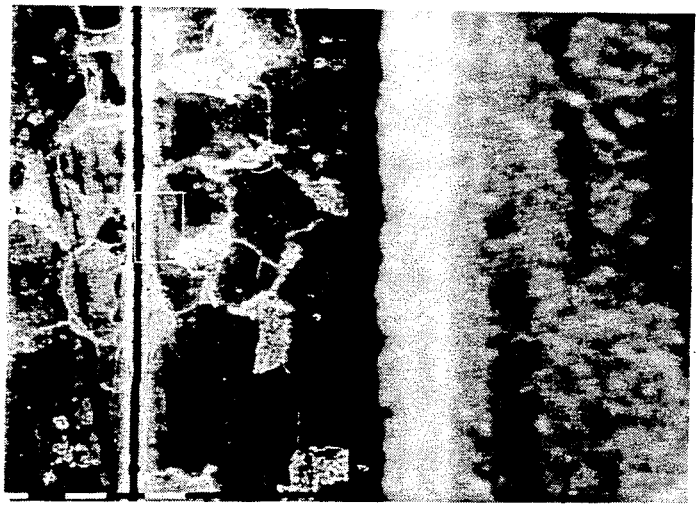
FIG. 41.
FIG. 42.
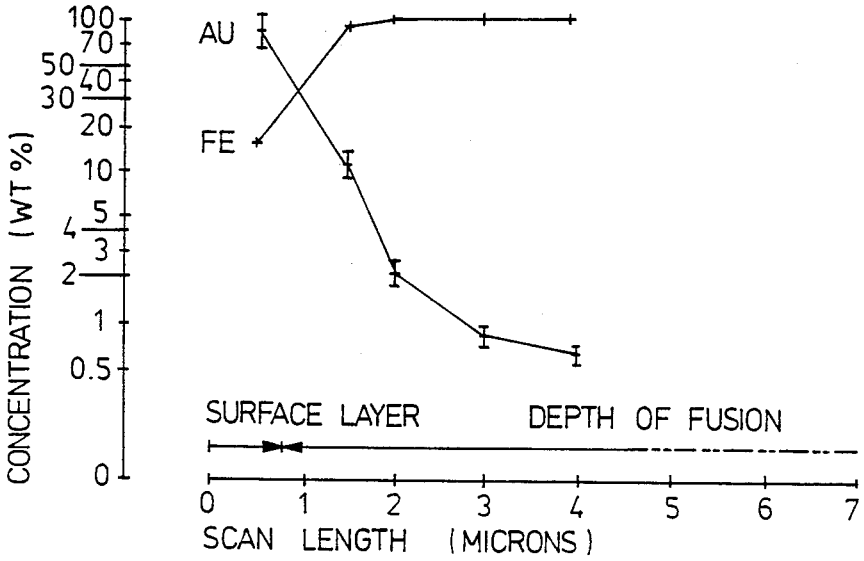

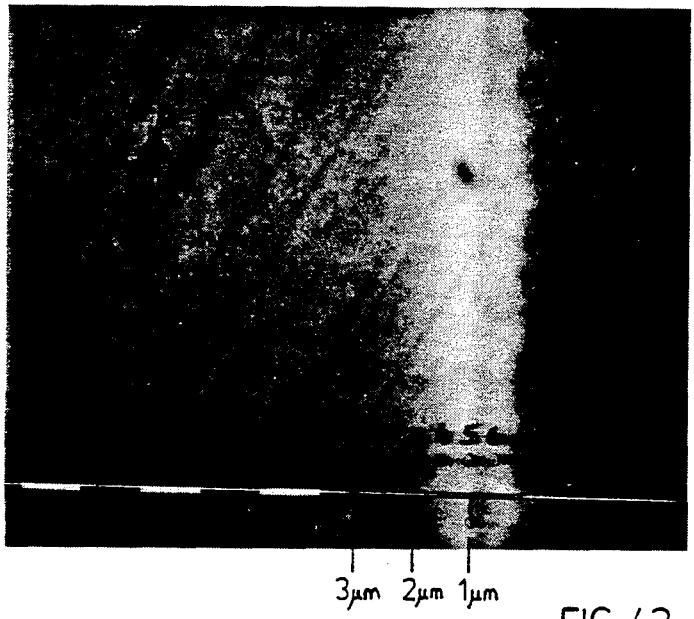
FIG. 43.
FIG. 44.
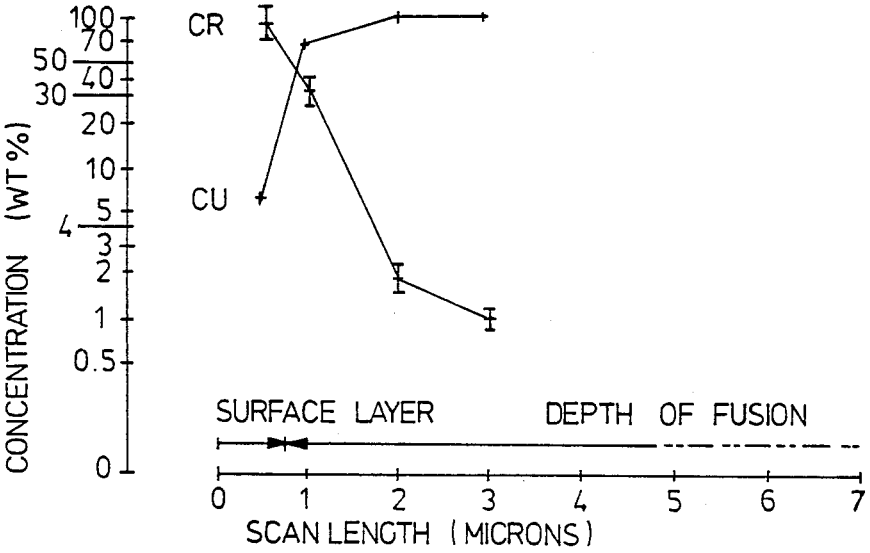

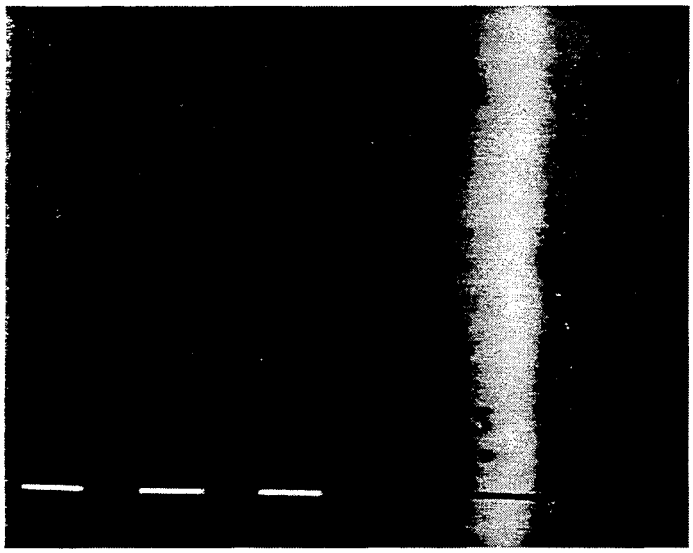
FIG.45.
FIG.46.
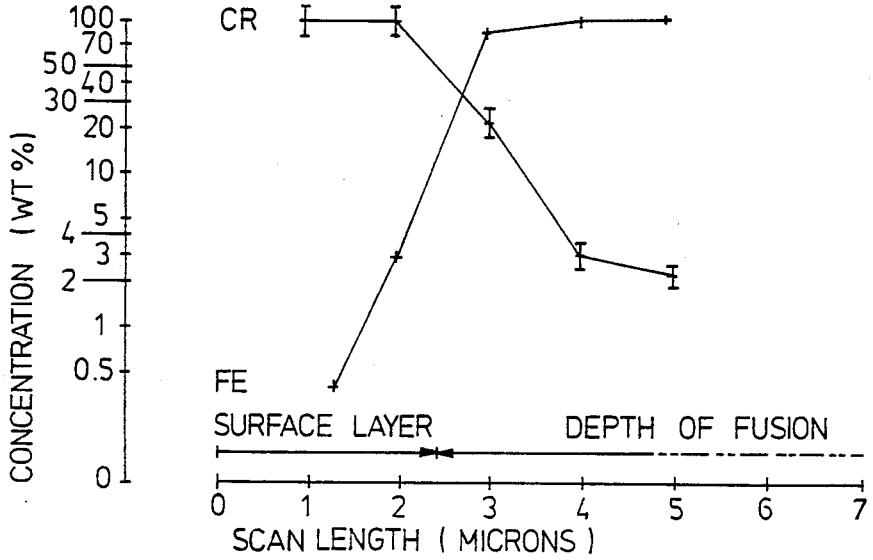

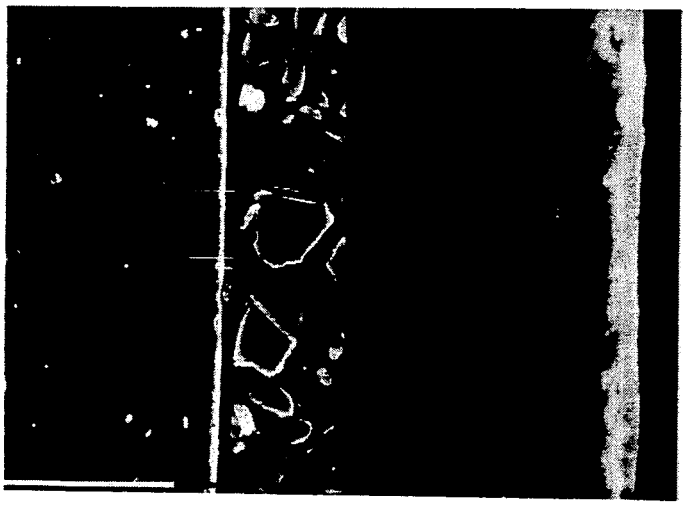
FIG.47.
FIG. 47A.
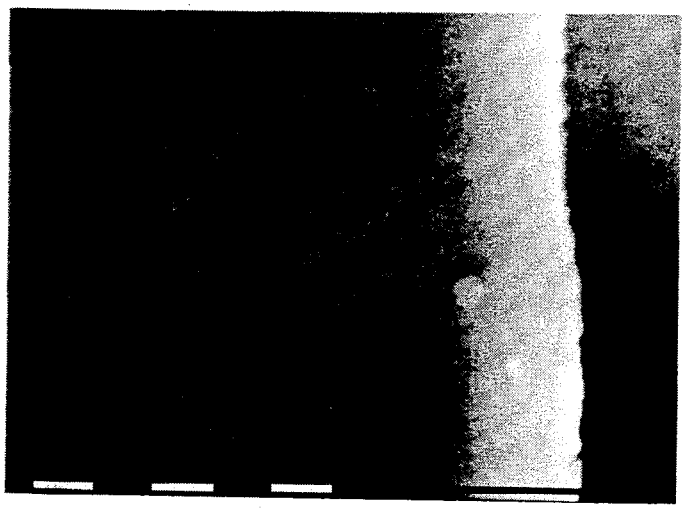

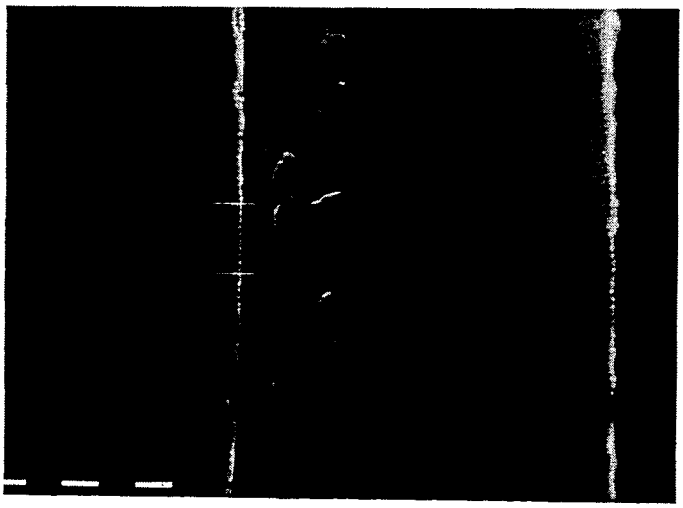
FIG. 49.
FIG. 49A.
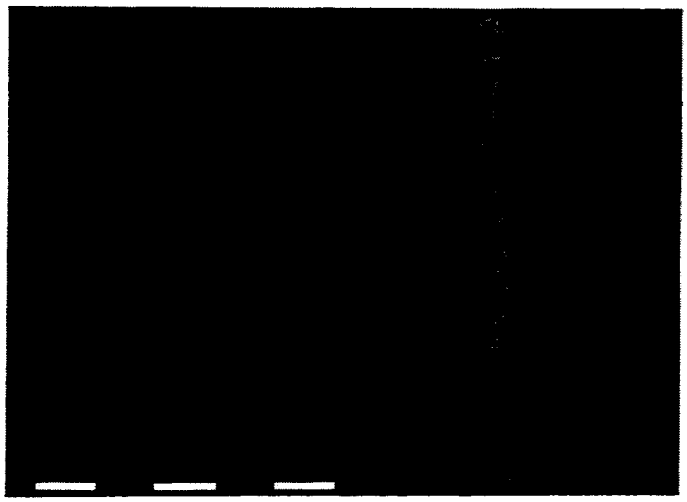

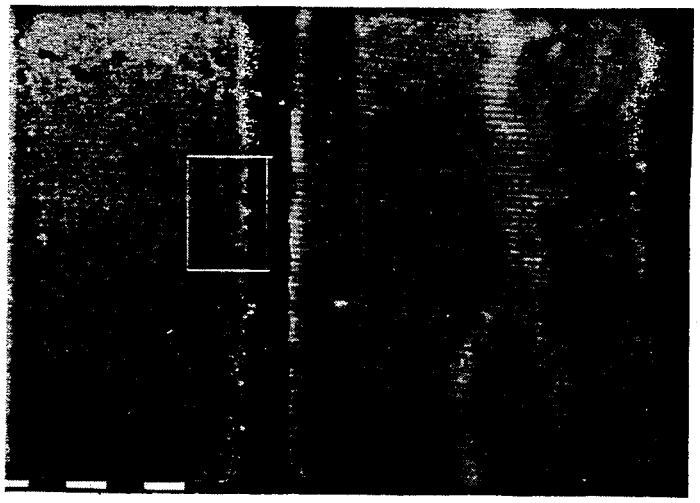
FIG. 51.
FIG. 52.
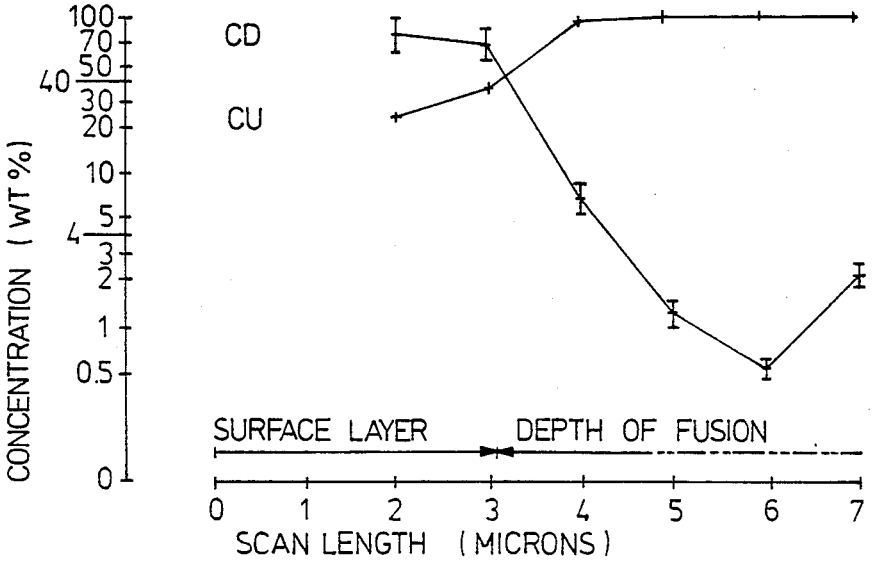

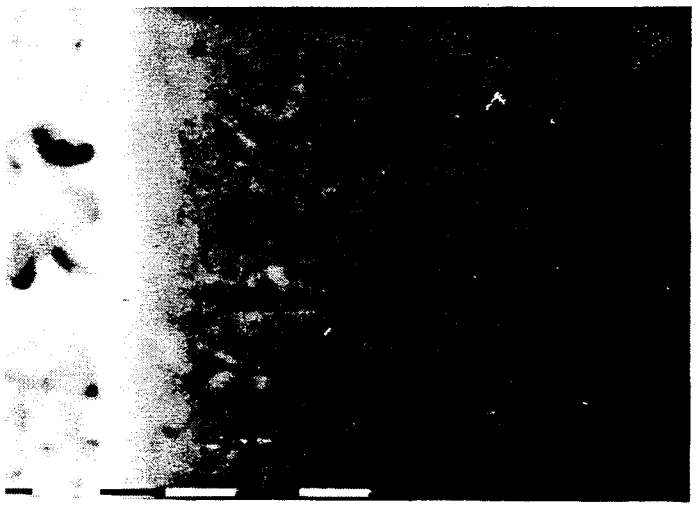
FIG. 53.
FIG. 54.
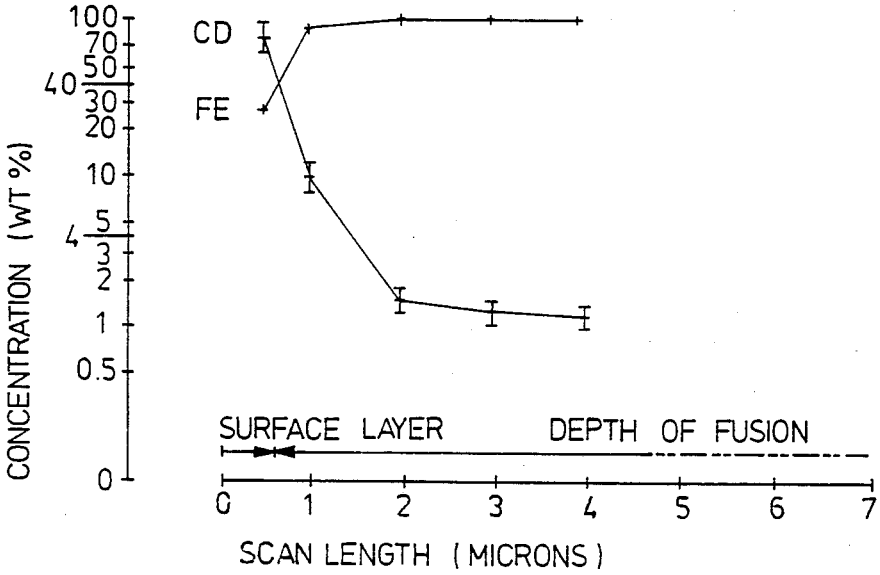

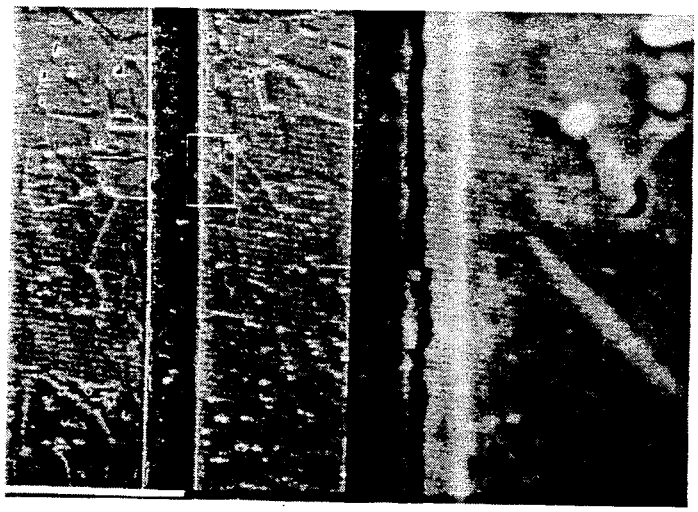
FIG. 55.
FIG. 56.
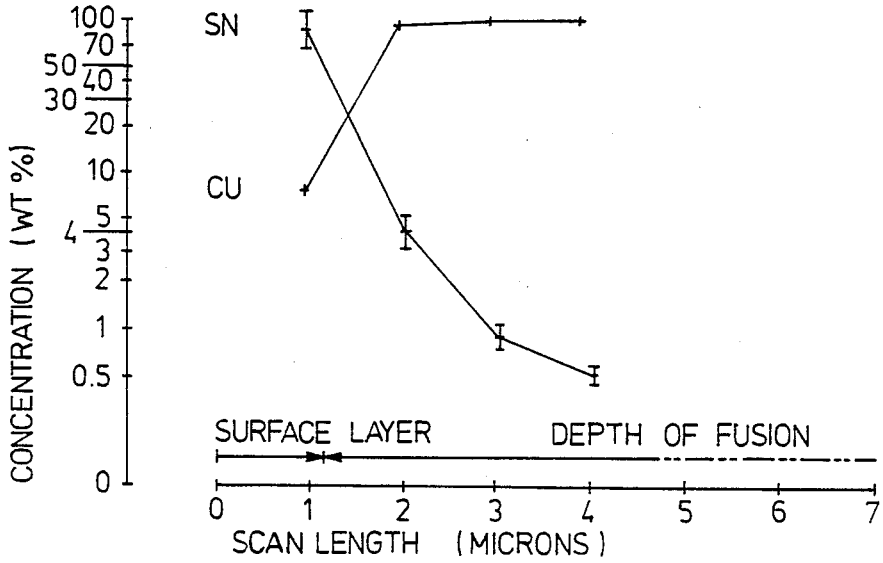

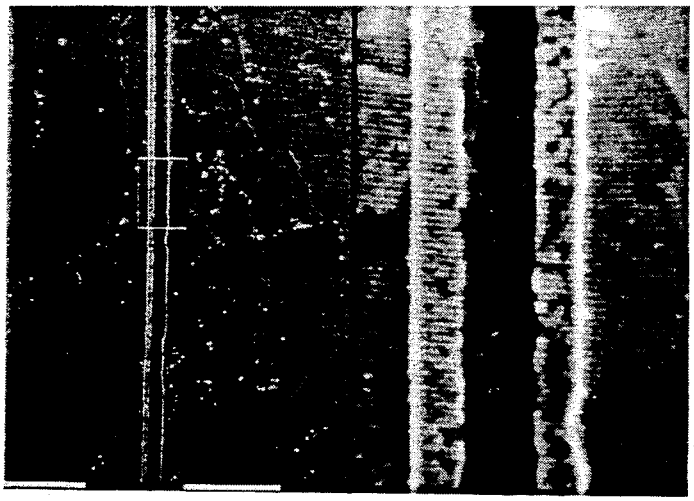
FIG. 57.
FIG. 58.
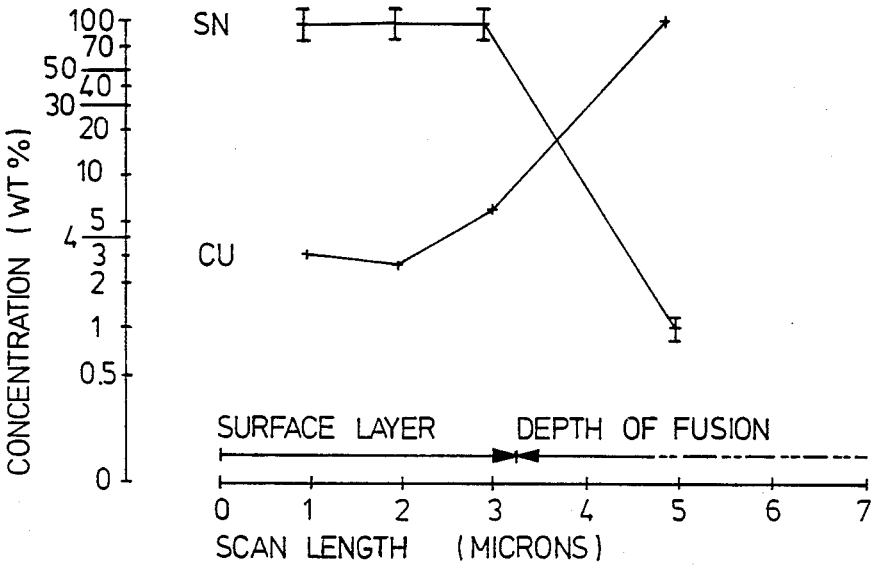

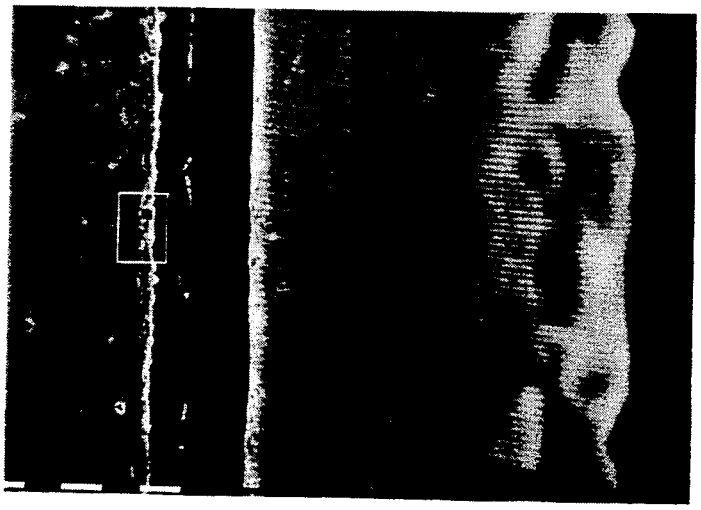
FIG. 59.
FIG. 60.
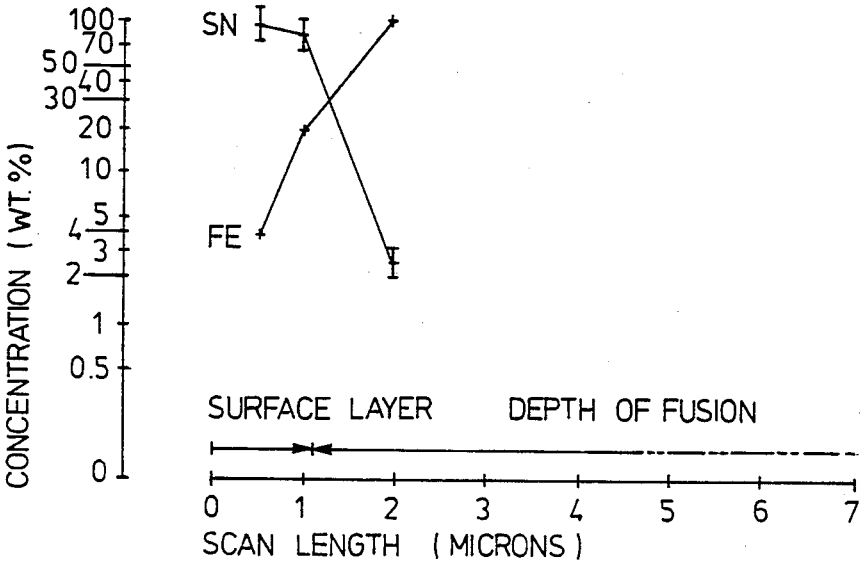

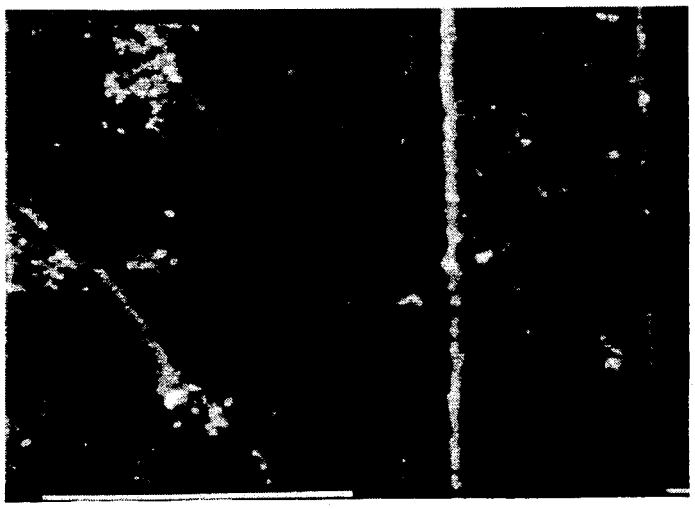
FIG. 61.
FIG. 62.
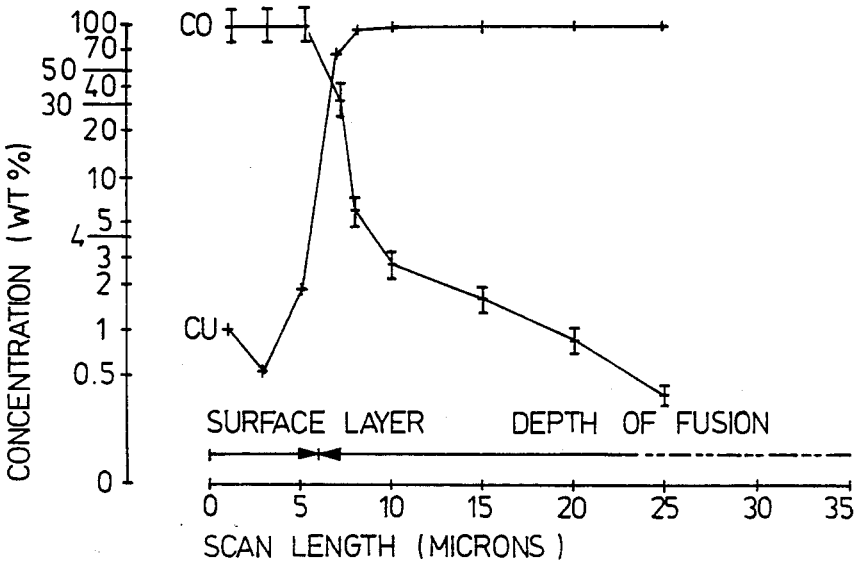

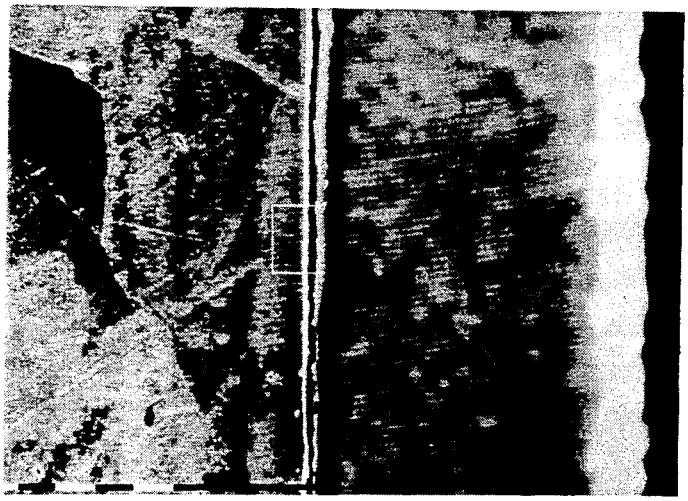
FIG. 63.
FIG. 63A.
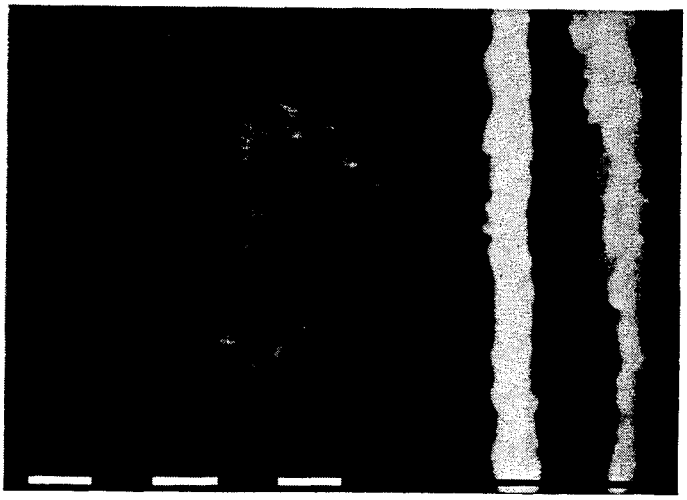

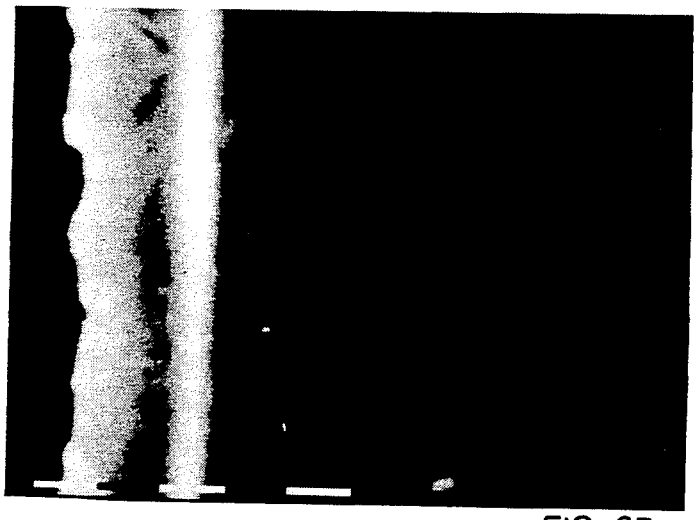
FIG. 65.
FIG. 66.
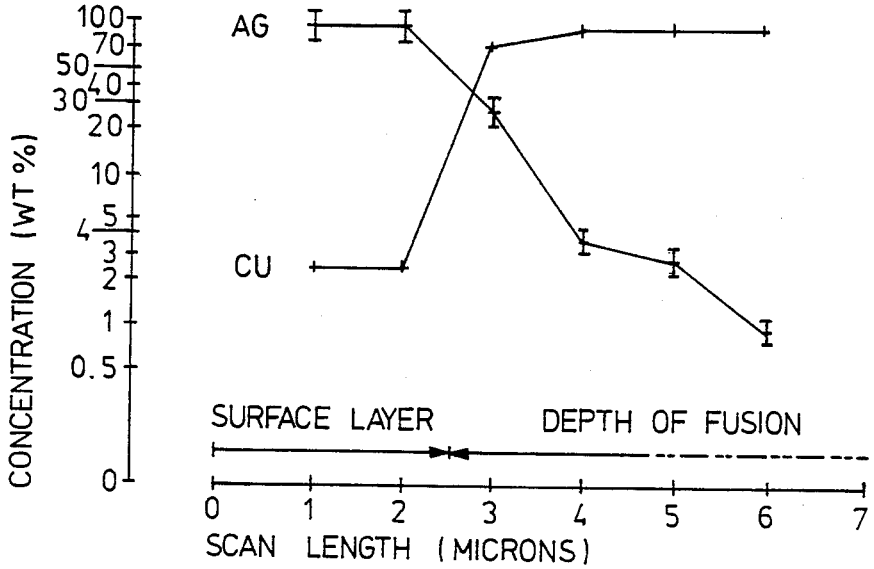

PROCESS AND APPARATUS FOR TREATING ELECTRICALLY CONDUCTIVE MATRICES AND PRODUCTS PRODUCED BY THE PROCESS

This is a continuation of application Ser. No. 319,678, filed Nov. 9, 1981, now abandoned, which was a continuation-in-part of application Ser. No. 224,762, filed Jan. 13, 1981, now abandoned.

The present invention relates to fusion processes, apparatus for carrying out such processes and the products of such processes.

It will be understood that for the purposes of this application that the term "fusion" is employed as meaning a process whereby diverse elements are chemically or physically bonded.

It has been a common practice to treat substrates or matrices in different manners to enhance the characteristics of the matrix for a particular application. Sometimes these treatments have involved the matrix as a body and in other techniques only the surface characteristics are enhanced.

However, these techniques have had limitations. The workpiece or matrix may be of a certain form which does not lend itself to the subjection of a particular characteristic-enhancing process; the process may be destructive of the already desirable characteristics of the work-piece; or the treated work-piece while having certain enhanced characteristics may exhibit other reduced characteristics.

Generally, the process employed depends upon the work-piece or matrix to be treated and the characteristics desired.

More specifically, coating techniques, heat treatment, anodizing, arc spraying, vacuum evaporation, chemical deposition, sputtering, and ion plating are all common processes.

Non-ferrous metals may be hardened by aging, heat treatment or anodizing.

These techniques however, do not provide adequate protection against dry rubbing wear.

Spray coating techniques have not improved corrosion resistance or the physical properties of ferrous materials.

The wear resistance of non-ferrous substrates have been improved by electrochemical or electromechanical plating with hard chromium but these are expensive and time consuming.

The other techniques arc-spraying, vacuum evaporation and sputtering have their shortcomings in that the coating deposited is usually thin, the interfacial bond strength is poor, or can only be used to treat small surface areas.

They have disadvantages in use in that they employ gaseous techniques or high voltages which are difficult in practice and limit their versatility.

For convenience of reference, in this description, the term "first conductive chemical element" shall refer to the matrix with which fusion is to be accomplished; and the term "chemical element" shall refer to such an element or an alloy thereof; the term "second conductive chemical element or an alloy thereof" shall refer to the element which is to be fused with the matrix.

It will also be understood that the term "fusion" as used in this specification means a penetration by the atoms or molecules of a second element within the solid matrix of a first element or alloy thereof.

SUMMARY OF THE INVENTION

Accordingly, it is an object of the present invention to at least partially overcome these disadvantages by providing a novel process and apparatus for fusing a wide variety of conductive elements to either ferrous and non-ferrous matrices.

It is a further object of this invention to provide a novel apparatus and method using a deposition technique at ambient temperatures which creates high bond strength without distortion or loss of work piece or matrix properties.

It is a further object of this invention to provide a process which does not require process gas-air operation and which does not involve safety hazards and which does not cause heat distortion.

It is still further object to provide a process which requires a low energy input yet which makes efficient use of the coating material.

It is a still further object of the invention to provide an apparatus which is low in cost and is portable and light-weight.

It is yet a further object of the invention to provide a process which produces a strong interfacial bond and which does not require skilled operators to use.

It is another object of the present invention to provide solutions of conductive chemical elements which may be employed to effect fusion of these chemical elements with solid matrices of other conductive elements or alloys thereof.

It is also an object of this invention to produce new and improved products which will have enhanced physical and chemical properties.

There is provided in accordance with the present invention a process, apparatus and solutions for altering the surface properties of a metal or alloy thereof at ambient temperatures by physically applying a second conductive chemical element to the surface whose characteristics are to be varied and applying a intermittent electrical signal of a predetermined frequency to both elements when they are in physical contact.

Apparatus is provided which comprises an oscillating circuit for generating a halfwave signal across the output and means for connecting across the output a second chemical element to be fused and the first chemical element to which the second is to be fused.

Solutions for use in the process and in association with the apparatus are also provided. These solutions comprise a solution of a conductive chemical of the chemical to be fused in a disassociable form which may be present in the range of 0.10% to 10% by weight and having a pH in the range 0.4 to 14. Advantageously the resistivity of the solution is in the range of 5 to 500 ohms cm, preferably 10 to 80 ohms cm.

By the application of the process to ferrous or non-ferrous matrices new products are produced, in which a second chemical conductive element is fused in a first chemical conductive element to a depth of more than 0.5 $\mu$m and a surface layer of the second chemical conductive element has been deposited to heights exceeding 0.5 $\mu$m.

These and other objects and features of the present invention will become more apparent from the following description and drawings in which certain specific embodiments of the process apparatus and products of the process are illustrative of the invention and in which:

FIG. 3 is a schematic electrical circuit employed in the present invention;

FIG. 4 is a circuit diagram of an oscillator as employed in apparatus in accordance with one embodiment of the present invention;

FIGS. 5–12 are EPMA line scans of a section of steel treated in accordance with the present invention with titanium carbide;

FIG. 18 is a graph of an SEM/EPMA scan across a sample of a steel matrix with which molybdenum has been fused and shows the fusion of molybdenum with steel;

FIG. 19 is a SEM/EPMA scan across a copper matrix with which tungsten has been fused using the process of the present invention with a tungsten solution;

FIG. 20 is a graph of an SEM/EPMA scan across a steel matrix with which tungsten has been fused using the process of the present invention with a tungsten solution and shows the fusion of tungsten with steel;

FIG. 21 is a graph of an SEM/EPMA scan across a copper matrix with which indium has been fused using the process of the present invention with an indium solution;

FIG. 22 is a graph of an SEM/EPMA scan across a steel matrix with which indium has been fused using the process of the present invention with an indium solution;

FIG. 23 is a graph of an SEM/EPMA scan across a copper matrix with which nickel has been fused using the process of the present invention with a nickel solution;

FIG. 24 is a graph of an SEM/EPMA scan across a steel matrix with which nickel has been fused using the process of the present invention with a nickel solution;

FIG. 25 is a graph of a SEM/EPMA scan across a copper matrix with which gold has been fused showing gold fused in the copper matrix;

FIG. 26 is a graph of an SEM/EPMA scan across a steel matrix with which gold has been fused using the process of the present invention with a gold solution showing gold fused in the steel matrix;

FIG. 27 is a graph of an SEM/EPMA scan across a copper matrix with which chromium has been fused using the process of the present invention with a first chromium solution and shows the fusion of chromium with copper;

FIG. 29 is a graph of an SEM/EPMA scan across a copper matrix with which chromium has been fused using the process of the present invention with a second chromium solution and shows the fusion of chromium with copper;

FIG. 30 is a graph of a SEM/EPMA scan across a steel matrix with which chromium has been fused using the process of the present invention with a second chromium solution and shows the fusion of chromium with steel;

FIG. 31 is a graph of an SEM/EPMA scan across a copper matrix with which cadmium has been fused using the process of the present invention with a first cadmium solution and shows the fusion of the cadmium with copper;

FIG. 32 is a graph of an SEM/EPMA scan across a steel matrix with which cadmium has been fused using the process of the present invention with a second cadmium solution and shows the fusion of cadmium with steel;

FIG. 33 is a graph of an SEM/EPMA scan across a copper matrix with which tin has been fused using the process of the present invention with a first tin solution and shows the fusion of tin with copper;

FIG. 34 is a graph of an SEM/EPMA scan across a copper matrix with which tin has been fused using the process of the present invention with a second tin solution and shows fusion of tin with copper;

FIG. 35 is a graph of an SEM/EPMA scan across a steel matrix with which tin has been fused using the process of the present invention with the second tin solution and shows fusion of tin with steel;

FIG. 36 is a graph of an SEM/EPMA scan across a copper matrix with which cobalt has been fused using the process of the present invention with a first cobalt solution and shows fusion of cobalt with copper;

FIG. 37 is a graph of an SEM/EPMA scan across a copper matrix with which silver has been fused using the process of the invention with a first silver solution and shows the fusion of silver with copper;

FIG. 38 is a graph of an SEM/EPMA scan across a copper matrix with which silver has been fused using the process of the present invention with a second silver solution and shows fusion of silver with copper;

In those FIGURES which are graphs, of FIGS. 5 through 38, the vertical axis is logarithmic while the horizontal axis is linear. And in these graphs the surface layer has been taken as the point at which the concentration (wt%) of the matrix and the element which has been fused therewith are both at 50% as indicated by the projections.

Figure 1:
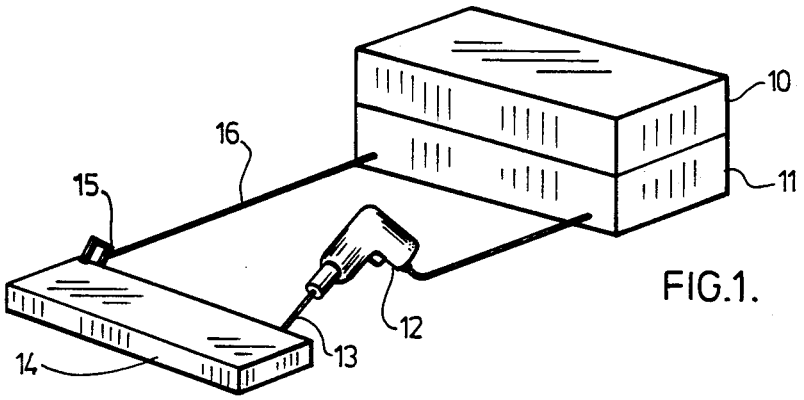
FIG. 1 is a general perspective view of one embodiment of the apparatus in according with the invention being used in accordance with a process of the present invention.
Figure 2:
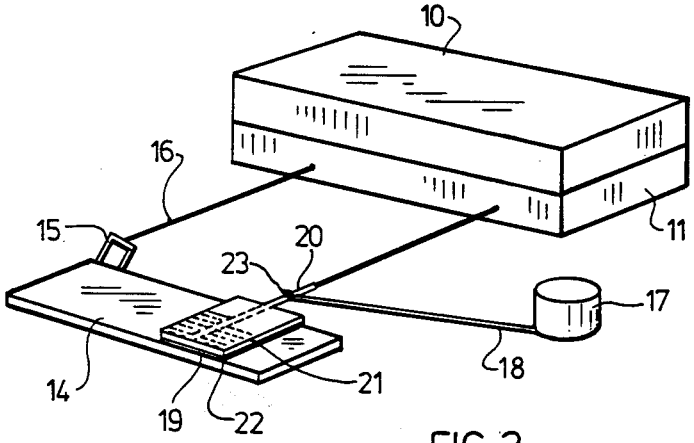
FIG. 2 is a general perspective view of a second embodiment of an apparatus in accordance with the invention being used in accordance with a process of the invention.

Referring now to drawings FIGS. 1 and 2 these drawings illustrate in general perspective view apparatus in accordance with the invention which is employed to carry out the process of the invention.

In FIG. 1, which exemplifies a solid-to-solid process the number 10 indicates a power supply and 11 an oscillator.

One side of the oscillator output is connected to an electrode 13 through a holder 12. Holder 12 is provided with a rotating chuck and has a trigger switch which controls the speed of rotation of the electrode 13. The speed of rotation is variable from 5,000 to 10,000 rpm.

The electrode 13 is composed of the material to be fused with the matrix. The matrix or substrate which is to be subjected to the process and which is to be treated is indicated at 14. The matrix is also connected to the other side of the oscillator output by a clamp 15 and line 16.

By these connections the electrode is positively charged and the matrix is negatively charged when the signal is applied.

In FIG. 2 the corresponding components are correspondingly numbered. However, in this embodiment the process employed may be characterized as a liquid to solid process. In this apparatus the material to be fused is in liquid form and is held in a reservoir 17. Reservoir 17 is connected by a tube 18 to an electrode 19. Electrode 19 is a plate provided with an insulated handle 20 through which one side of oscillator 11 output is connected. This output is led into a main channel 21 in electrode 19. Channel 21 has a series of side channels 22 which open on to the undersurface of electrode 20. The flow from reservoir 17 is by gravity or by a pump and may be controlled by a valve such as 23 on the handle 20. For further control, more even distribution of the solution, and to prevent the inclusion of foreign matter the surface of electrode 19 is preferably covered by a permeable membrane such as cotton or nylon.

It has been found that to effect fusion that the application of 50,000 watts/sq. cm. or alternatively the application of current of the order of 10,000 amps/sq. cm. is necessary.

From a practical standpoint 10,000 amps/sq. cm. can not be applied constantly without damage to the matrix to be treated.

However, it has been found practical to apply a pulsing signal of 2.5 microseconds to 28.6 nanoseconds having a magnitude of 3 amps to the electrode and this causes fusion to occur over an area of approximately 0.3 sq. mm.

To effect fusion over an area with the apparatus shown in FIG. 1 the electrode 13, matrix 14 and the oscillator output are connected as shown.

The operator passes the rotating electrode 13 in contact with the upper surface of the matrix over the matrix surface at a predetermined speed to apply the electrode material to the matrix and fuse it therewith.

It has also been found that the continuous application of an alternating signal generates considerable heat in the substrate or matrix and to overcome this heat build-up and avoid weldments the signal generated in the present apparatus is a half-wave signal which permits dissipation of the heat.

As will be apparent to those skilled in the art each material, both the matrix and the material to be applied have specific resistance characteristics. Thus with each change in either one or both of these materials there is a change in the resistivity of the circuit.

In FIG. 3, $R_1$=the resistance of the electrode, $R_2$=the resistance of the matrix, and $R_3$=the resistance of the circuit of 10 and 11.

Variations in $R_1$ and $R_2$ will lead to variations in the frequency of the signal generated and the amplitude of that signal.

As mentioned previously a signal having an amplitude of 3 amps is believed to be the preferred amplitude. If the amplitude is greater decarbonizing or burning of the matrix takes place and below this amplitude hydroxides are formed in the interface.

FIG. 4 is a schematic diagram of an oscillator circuit used in apparatus in accordance with the present invention.

In that circuit a power supply 30 is connected across the input, and across the input a capacitor 31 is connected. One side of the capacitor 31 is connected through the LC circuit 32 which comprises a variable inductance coil 33 and capacitor 34 connected in parallel.

LC circuit 32 is connected to one side of a crystal oscillator circuit comprising crystal 35, inductance 36, NPN transistor 37 and the RC circuit comprised of variable resistance 38 and capacitance 39.

This oscillator circuit is connected to output 50 through, on one side capacitor 40, and on the other side diode 41, to produce a halfway signal across output 50.

In the apparatus actually used the several components had the following characteristics:

31=1.2 farad
32=0.3 picrofarad
33=0–25 millihenrys
35=400–30 Khz
36=20 millihenrys
37=NPN
38=3.5μ farads
39=0–500 ohms
40=400μ farads
41=diode To maintain the amplitude of the signal at 3 amps $R_1$ resistance 38 is varied; to vary the frequency inductance 33 is varied.

If C=the capacitance of the circuit of FIG. 3 and $R_1$, $R_2$ and $R_3$ are the resistances previously characterized it is believed that the optimum frequency of the fusing signal $F_o$ may be determined by the form $$F_o = \frac{1}{2\pi\sqrt{LC}} \qquad \text{FORM I}$$

where $$L = R_1 \cdot R_2 \cdot R_3$$

and

C=capacitance of the circuit

L and C may be determined by any well-known method.

$F_o$ depends on the material being treated and the material being applied but it is in the range 400 Hz–35 MHz. The frequency, it is believed, will determine the speed of the process.

To fuse a predetermined area, the area is measured. Since each discharge will fuse approximately 0.3 sq. mm. then the travel speed may be determined by the following form:

$$\text{Travel speed} = \frac{F_1 \times .3 \times 60\ /\text{mm/minute}}{A} \qquad \text{FORM II}$$

-continued $$\frac{F_1 = F_o}{2}, \text{ and}$$

$A$ = area to be covered in sq. mm.

$F_1$ is the number of discharges per second.

As mentioned previously the resistances $R_1$ and $R_2$ may be measured by any known means.

However it has been discovered that the measurement of resistance in the liquid phase may not be stable. In this situation the resistance is measured in a standard fashion. Two electrodes, 1 cm. apart and 1 cm. sq. in area are placed in a bath of the liquid phase and the resistance was measured after a 20 second delay. After the variable parameters have been determined and the apparatus, matrix and probe have been connected as shown in FIGS. 1 and 3, the probe 13 is passed over the surface of the matrix in contact therewith at the predetermined speed.

The speed of rotation is also believed to affect the quality of the fusion with a rotation speed of 5,000 rpm the finish is an uneven 200 to 300μ finish; with a speed of rotation of 10,000 rpm the finish is a substantially 15μ finish.

The apparatus of FIG. 2 is operated in the same manner as the apparatus of FIG. 1 and the process is essentially the same except for the use of a liquid with a solid electrode.

The process may be more clearly understood from the following specific examples.

In each of these examples the electrode was so connected as will be apparent from the description, so that when charged the electrode is positively charged and the matrix is negatively charged.

The solid to solid process is illustrated by Examples I, II, IIA, III, and IV.

EXAMPLE I

Atlas A151 01 tool steel was connected to the apparatus of FIG. 1 as the matrix 14 and the electrode 13 was titanium carbide as Kennametal K165.

The following were the characteristics and conditions of treatment:

| | |
|---|---|
| Matrix Resistance | .002 ohms |
| Probe Resistance | .026 ohms |
| Circuit Resistance | .01 ohms |
| Frequency ($F_1$) | 12 KHz at 4.62 μFarad |
| Voltage | 3 volts |
| Speed of Application | 50 cm/minute |
| Depth of Treatment | ≈40 μm |
| Surface Buildup | ≈0.5 μm |

The results of the treatment of the Atlas A151 01 tool steel with the titanium carbide are shown in the microphotographs and spectrometer scans of FIGS. 5 through 17.

The polished titanium carbide treated steel was examined by SEM/EPMA. X-ray spectra were taken at several locations and are shown in the graphs which are FIGS. 5 through 12 and which correspond to locations 1 through 8, respectively.

Figure 7:
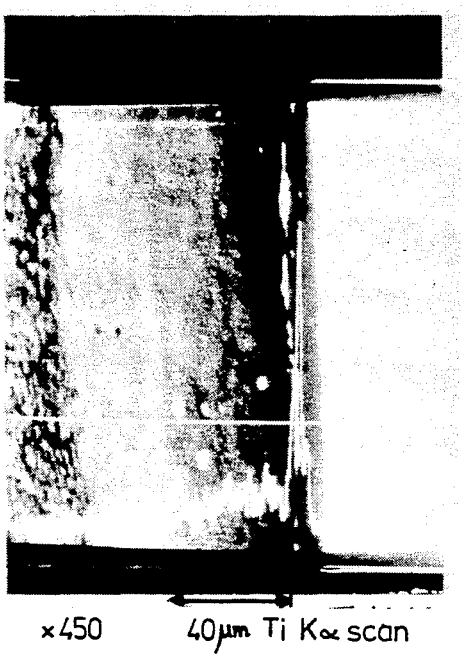
Figure 8:
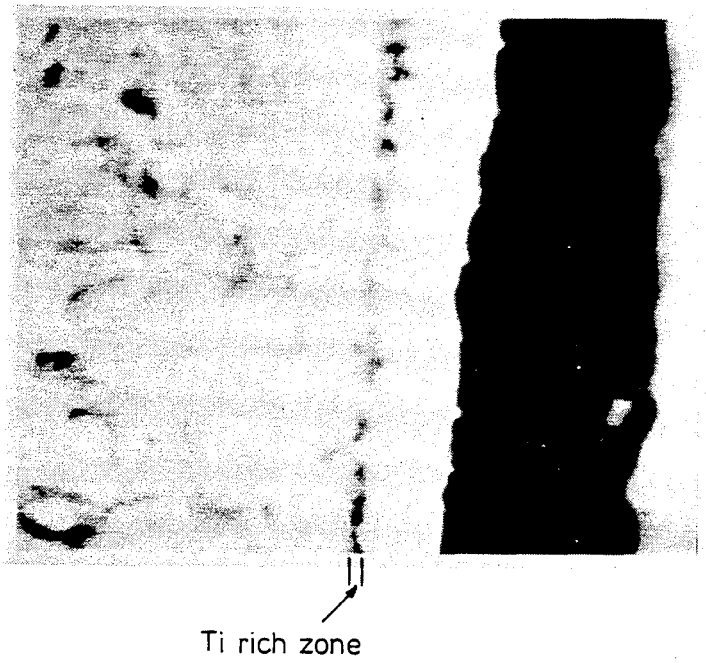
Figures 9, 10, 11, 12:
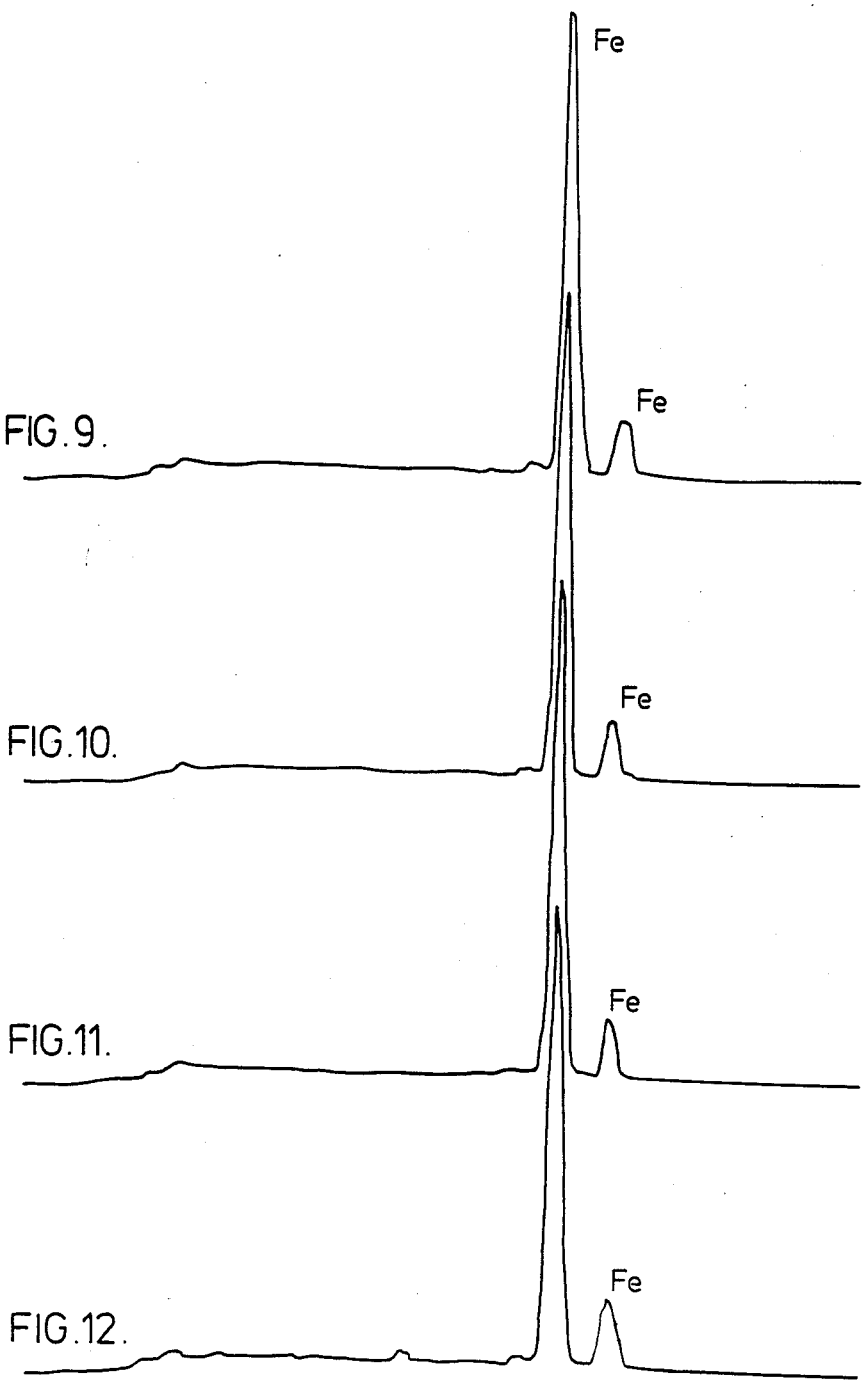

FIGS. 5, 6 and 7 give spectra from the parent metal.

FIGS. 8 through 12 show the presence of a small titanium peak which does not change markedly in height as the zone was crossed.

The approximate width of the zone in which titanium was detected is about 50 m although this dimension varied along the specimen length.

An examination of the surface layer using a microprobe analyzer showed the titanium level to be fairly constant to measured depth of about 40 μm from the surface.

Figures 13, 14, 15, 16:
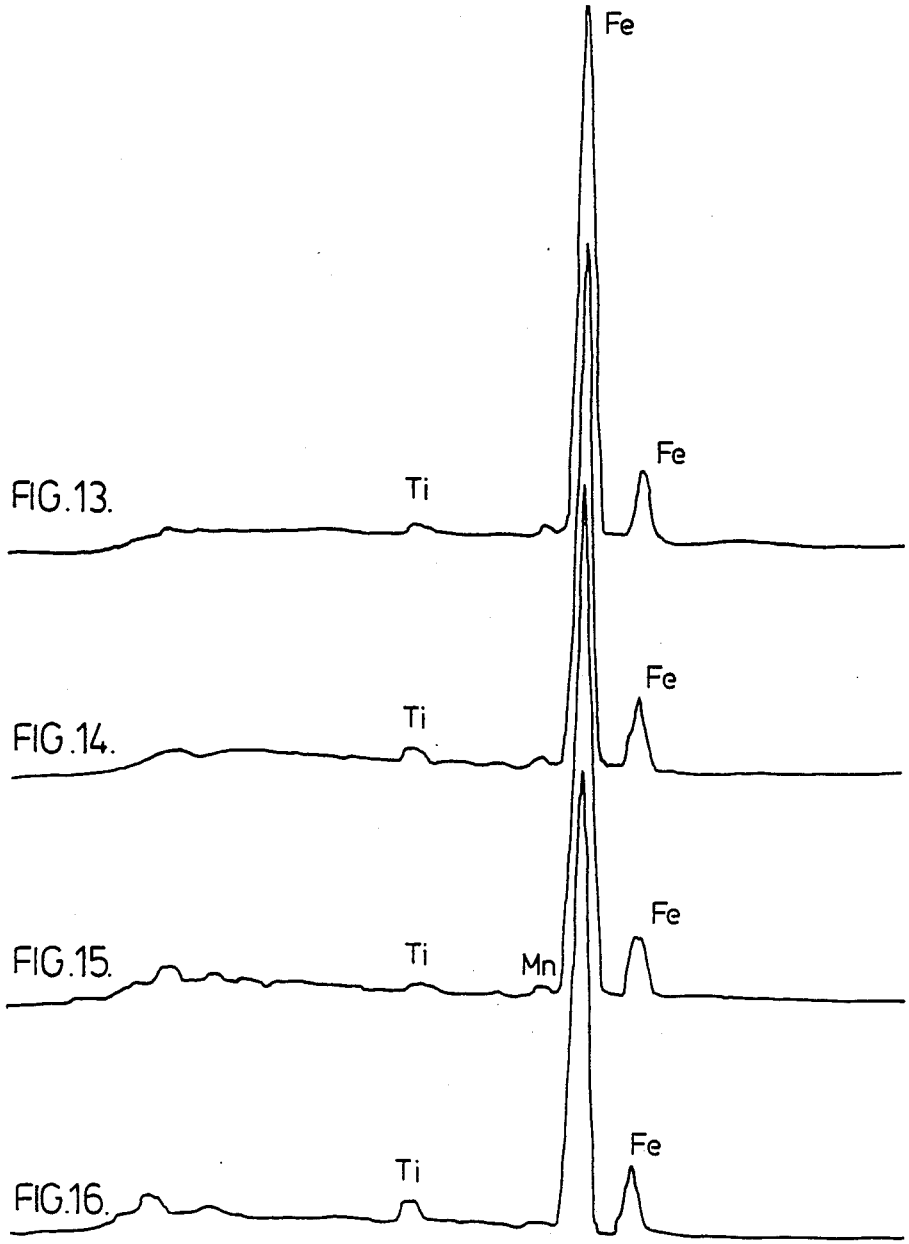
FIG. 13 is an EPMA scan of the Ti rich zone of a section of steel treated in accordance with the present invention with titanium carbide.
FIG. 14 is a graph of an SEM/EPMA scan across a sample wherein molybdenum has been fused to steel using the process of the present invention with a solid molybdenum electrode and shows the fusion of molybdenum with the steel.
FIG. 15 is a graph of an electron microscope scan across the sample scanned in FIG. 14 and shows the fusion of molybdenum with steel.
FIG. 16 is a SEM/EPMA scan of a steel matrix with which tungsten has been fused using the process of the present invention with a solid tungsten electrode and shows the fusion of tungsten with the steel.

The sample was then given a heavy nickel coating and repolished. The resulting scanning electron micrograph indicated a surface coating of about one half of one micron. FIG. 13 is an X-ray spectrum of this layer.

A hardness survey was then conducted on the coated steel sample and the results were as indicated in Table I.

TABLE I

| Knoop Hardness Tests 100 g Load | | | |
|---|---|---|---|
| Distance from specimen edge (in) | | K H N (1) | K H N (2) |
| .0005 | Ti enriched zone | 578 | 516 |
| .001 | Ti enriched zone | 650 | 728 |
| .0015 | Ti enriched zone | 536 | 770 |
| .002 | | 655 | 872 |
| .0025 | | 790 | 1006 |
| .003 | | 863 | 1006 |
| .004 | | 955 | 453 |
| .005 | | 536 | — |
| .01 | | 243 | 148 |

As will be apparent the hardness characteristics of the steel were considerably enhanced.

EXAMPLE II

1018 Steel was connected to the apparatus of FIG. 1 as the matrix 14 and the electrode 13 was molybdenum, Type Mo 1. The steel was ½" wide×¼" thick×1½" long, the molybdenum 1" long×4 mm diameter. The frequency applied was 43.31 KHz. and the speed of electrode rotation approximately 12,000 rpm.

The surface of the steel was ground to a surface finish of 600 grit. The electrode tip was moved manually along the top surface of the steel sample in straight lines adjacent to each other. The process was repeated at 90° to cover the whole surface. Under the optical microscope at ×40 magnification small beads of melted and resolidified material were revealed.

The fusion of molybdenum with steel was quite evident.

The results of an electron microprobe scan across the interface revealed molybdenum to be present to a depth of at least 15 μm as shown in the Table below and FIG. 14.

| DEPTH μm | WT % Mo | WT % Fe |
|---|---|---|
| 1 | 6.9 | 93.1 |
| 2 | 7.6 | 92.4 |
| 3 | 7.0 | 93.0 |
| 4 | 7.5 | 92.5 |
| 10 | 6.6 | 93.4 |
| 15 | 6.0 | 94.0 |

Microhardness measurements were taken on the cross-section of the sample with the following results:

| Knoop Hardness Number | Load | Depth from Surface |
|---|---|---|
| 493 | 200 gm | 30 μm |

-continued

| Knoop Hardness Number | Load | Depth from Surface |
|---|---|---|
| 198 | 200 gm | 40 μm |

The average KHN of the untreated steel was 188. The hardness of the same steel after heating to 900° C. and water quenching was 285 (KHN) at 200 gm.

EXAMPLE IIA

The same matrix and electrode and procedure as in Example II were followed at a frequency of 30.63 KHz and the same speed of rotation.

Under the optical microscope small beads of melted and resolidified material were revealed.

The fusion of molybdenum with steel was again quite evident.

The results of an electromicroprobe scan across the interface revealed molybdenum to be present to a depth of at least 50 μm as shown in FIG. 15 an the following Table:

| DEPTH μm | WT % Mo | WT % Fe |
|---|---|---|
| 10 | 8.8 | 91.2 |
| 20 | 11.2 | 88.8 |
| 30 | 3.6 | 96.4 |
| 40 | 3.6 | 96.4 |
| 50 | 2.5 | 97.5 |

Knoop microhardness measurements were taken on the cross-section of the sample. The results were as follows:

| DEPTH μm | KHN | LOAD |
|---|---|---|
| 15 | 375 | 200 |
| 25 | 506 | 200 |
| 40 | 445 | 200 |
| 150 | 227 | 200 |
| 500 | 188 | 200 |

The hardness values of Examples II and IIA which exceed KHN 285 result from the presence of molybdenum.

EXAMPLE III

Steel of the specifications as in Examples II and IIA was connected to the apparatus of FIG. 1 as the matrix 14 and the electrode 13 was tungsten carbide (Kennametal Grade No. 68). This electrode was 5 mm diameter × 1" long.

The frequency applied was 26.20 KHz and the speed of electrode rotation was approximately 12,000 rpm.

The procedure followed was the same as in Examples II and IIA.

The tungsten fused with the steel matrix. The results of an electron microscope analysis across the sample indicate the presence of tungsten to a depth of at least 80 μm and are shown in FIG. 16 and the following table:

| DEPTH μm | WT % W | WT % Fe |
|---|---|---|
| 1 | 24.4 | 75.6 |
| 5 | 27.5 | 72.5 |
| 10 | 1.7 | 98.3 |
| 20 | 1.8 | 98.2 |
| 50 | 1.1 | 98.9 |

-continued

| DEPTH μm | WT % W | WT % Fe |
|---|---|---|
| 80 | 1.7 | 98.3 |

Knoop microhardness measurements were taken on the cross-section of the sample. The results were as follows:

| DEPTH μm | KHN | LOAD |
|---|---|---|
| 28 | 908 | 200 gm |
| 45 | 718 | 200 gm |
| 75 | 329 | 200 gm |
| 120 | 220 | 200 gm |

The hardness of the untreated sample is approximately 188 KHN and after heating to 900° C. and quenching was 285 KHN.

It is quite evident from the foregoing that the treatment of the steel matrix quite clearly enhances the surface hardness and it is useful in those applications where surface hardness is an important requirement.

With respect to the fusion of the second conductive chemical element into the solid matrix of a first conductive chemical element, using a solution of the second conductive chemical, with respect to each solution, the process was carried out at the ambient temperature, 20° C., in the following manner.

The matrix 14 metal was connected into the circuit as previously described. The frequency was determined in accordance with the formula previously set forth and the solution in reservoir 17 applied by movement of the electrode over one surface of the first metal for varying periods of time as determined by Form II. To ensure uniform distribution of the second metal solution over the surface of the first metal the electrode was covered with cotton gauze or nylon. It will be apparent that other materials may be employed. This arrangement also served to limit contamination of the solution when graphite electrodes were employed. They had a tendency to release graphite particles in the course of movement.

The treated samples were then sawn to provide a cross-sectional sample, washed in cold water, subject to ultrasonic cleaning, embedded in plastic and ground and polished to produce a flat surface and an even edge. With other samples with the softer metals where there was a tendency to lose the edge on grinding two cross-sections were secured with the treated surface in face to face abutting relationship, embedded as before and ground and polished.

Following embeddment the sample was etched using Nital for steel, the ferrous substrate, and Ammonium Hydrogen Peroxide on the copper, the non-ferrous substrate.

During the course of some applications it was found that adjustments were sometimes required in either the frequency, or speed of application. These were due to changes in the solution composition or variations in the matrix.

A semiquantitative electron probe microanalysis of fused interfaces were performed using an Energy Dispersive X-Ray Spectroscopy (EDX) and a Scanning Electron Microscope (SEM).

The surface of the embedding plastic was rendered conductive by evaporating on it approximately 20 μm layer of carbon in a vacuum evaporator. This procedure was used to prevent buildup of electrical charges on an otherwise nonconductive material and a consequent instability of the SEM image. Carbon, which does not produce a radiation detectable by the EDX, was used in preference of a more conventional metallic coating to avoid interference of such a coating with the elemental analysis.

Operating conditions of the SEM were chosen to minimize extraneous signals and the continuum radiation and to yield at the same time the best possible spatial resolution.

The conditions typically used for the elemental analyses by EDX were as follows:

| | |
|---|---|
| Accelerating potential | 10–20 kV |
| Final Aperture | 200–300 |
| Spot size | 50 nm |
| Beam current | 100–300 pA |
| Working distance | 12–34 mm |
| Magnification factor | 5,000–10,000 |
| Specimen angle | normal to the beam |
| Take-off angle | 225° |
| Count rate | 800–2000 cps |
| Live time | 60–180 sec. |

Energy calibration was tested using Al kd emission at 1.486 keV and cu K at 8.040 keV.

A standardless semiquantitative analysis was adopted for determination of elemental concentration, using certified reference materials (NBS 478, 78% Cu—27% Zn and NBS 479a, Ni, 11%, Cr 18%, Fe) to verify results. Multiple analysis of reference materials were in excellent agreement with certified values from NBS. Average precision of ±1% was achieved. A size of analysed volume was calculated from the following equation 1:

$$pR_{(x)}=0.064(E_o^{68}-E_c^{68})$$

where $R_{(x)}$ is the mass range (th x-ray production volume)

p=Density of analysed material $E_o$=The accelerating potential $E_c$=A critical excitation energy.

The diameter of analysed volume was calculated for typical elements analysed and was found to be as follows:

| | |
|---|---|
| Ni | 0.46 |
| Cu | 0.39 |
| Fe | 0.55 |
| W | 0.30 |

For assessment of the diffusion depth a static beam was positioned across the interface at intervals greater than the above mentioned mass range. Ensuring thus the accuracy of the analysis.

The results of elemental concentration were given in weight percentage (Wt%) for each of the measured points across the fusion interface.

In the various examples which will be described the second conductive chemical element, that is the element to be diffused into the matrix, is present. In some solutions small quantities of metallic ions are also provided. The presence of these metal ions is believed to be required as complex forming agents to facilitate fusion. Small quantities of organic catalysts such as gum acacia, hydroquinone, animal glue, pepsin, dextrin, licorice, or their equivalents may also be present.

Wetting agents such as sodium lauryl sulphate or its equivalent are usually provided.

Where required pH varying agents such as ammonium hydroxide or sulphuric acid are usually added to reach an operating pH.

Certain further solutions require second chemical conductive element complexing agents which preclude precipitation of the second element. These agents were by way of example citric acid, or sodium pyrophospate, or ethyldiaminetetracetic acid or their equivalents.

A suitable buffer is also provided in certain solutions, where required.

The water is always demineralized.

And for certain applications where the appearance of the product requires an elegant appearance small quantities of brighteners such as formaldehyde, carbon disulphide, benzene, sulphonic acid or their equivalents may be employed.

In these Examples, unless otherwise indicated the steel matrix was ASA 1018 and the copper was ASTM B-1333 Alloy 110.

EXAMPLE IV

Atlas A151 1020 steel was connected in the apparatus of FIG. 2 as the matrix 14 and a 10% solution of ammonium molybdate in water was placed in reservoir 17.

The following were the characteristics and conditions of treatment:

| | |
|---|---|
| Matrix Resistance | .0018 ohms |
| *Probe Resistance | 150 kiloohms |
| Circuit Resistance | .01 ohms |
| Frequency | 650 Hz at 0.4 picrofarad |
| Contact Area | 2 sq. cm. |
| Speed | 60 cm./minute |
| Depth of Treatment | ≈0.5 μm |
| Surface Buildup | ≈15 μm |

*Determined by measurement across 1 sq. cm. plates spaced apart 1 cm. after a 20 second delay.

The sample of Example IV was subject to a thermal corrosion test. 25% sulphuric acid was applied to the surface for 20 minutes at 325° C. without any surface penetration.

EXAMPLE V

An aqueous solution of the following formulation was prepared:

| NAME | GRAM/LITER |
|---|---|
| Sodium Molybdate | 37.8 |
| Ferrous Ammonium Sulphate | 7 |
| Ferric Ammonium Sulphate | 8.6 |
| Citric Acid | 66.0 |
| Water (distilled) | 997 ml. |
| Sodium Lauryl Sulphate | 0.5 |
| Ammonium Hydroxide | to required pH |
| Acacia (gum arabic) | 0.1–0.2 |
| Formaldehyde | 7.5 ml. |

The solution had the following characteristics:

| | |
|---|---|
| pH = | 7.5 |
| Resistivity = | 19 ohms cm |
| $Mo^{+6}$ concentration = | 1.8% by wt. |
| $Fe^{+2}$ = | 0.10% by wt. |

-continued

| | |
|---|---|
| $Fe^{+2}$ = | 0.10% by wt. |

The $Mo^{+6}$ concentration may be varied from 1.5% to 2.5% by weight; the pH from 7.2 to 8.2 and the resistivity from 17–25 ohms cm.

Reaction Conditions

| | |
|---|---|
| Matrix | Copper |
| Electrode | Graphite |
| Electrode Cover | Woven cotton |
| Frequency | 9.09 KHz |
| Rate of Application | 736.2 mm/minute |
| Time of Application | 2 minutes |

In the solutions set out in Examples V and VI the presence of the ferrous and ferric ions are believed to serve to reduce the $Mo^{+6}$ valency state to a lower valency state.

Figure 17:
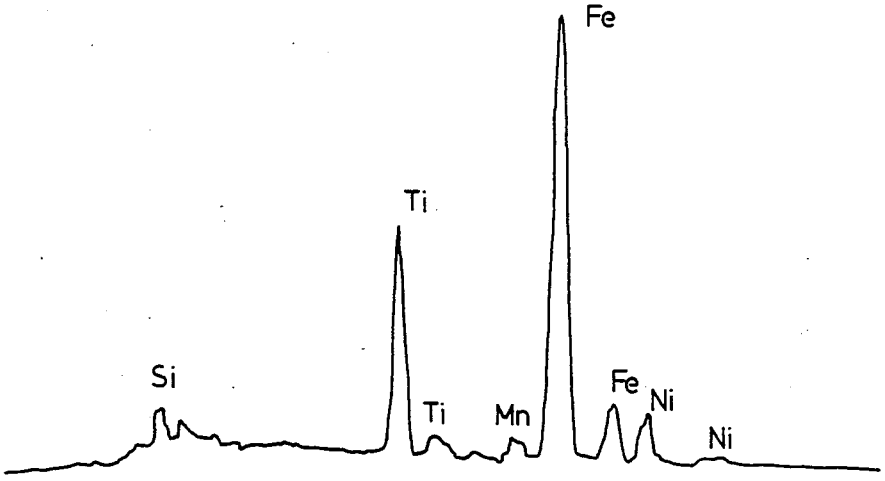
FIG. 17 is a SEM/EMPA scan of a copper matrix with which molybdenum has been fused using the process of the present invention with a molybdenum solution and shows the fusion of molybdenum with copper.

While iron is apparantly concurrently transferred as illustrated in FIG. 17 the iron has apparently no material effect on the characteristics of the matrix or the molybdenum.

An examination of the sample with an optical microscope shows a continuous coating of molybdenum free from pitting and with a dark silver colour.

As shown in the table below and FIG. 17 an SEM/EPMA scan across the interface between the matrix and the applied metal, molybdenum is seen to be fused to a depth of at least 4 μm with a surface deposit of approximately 1 μm.

TABLE

| DEPTH um | ELEMENT | CONCENTRATION (WT %) |
|---|---|---|
| 0.5 | Mo | 65.4 |
| | Fe | 19.9 |
| | Cu | 14.5 |
| 1.0 | Mo | 58.4 |
| | Fe | 10.9 |
| | Cu | 30.5 |
| 2.0 | Mo | 6.6 |
| | Fe | 0.8 |
| | Cu | 92.5 |
| 3.0 | Mo | 2.9 |
| | Fe | 0.4 |
| | Cu | 96.6 |
| 4.0 | Mo | 0.9 |
| | Fe | 0.0 |
| | Cu | 98.9 |

EXAMPLE VI

An aqueous solution of the same formulation as Example V was prepared and applied under the following conditions:

Reaction Conditions

| | |
|---|---|
| Matrix = | Steel (ASA 1018) |
| Electrode = | Graphite |
| Electrode Cover = | Woven cotton |
| Frequency = | 4.11 KHz |
| Rate of Application = | 739.8 mm/minute |
| Time of Application = | 3 minutes |

Examination under the optical microscope showed a continuous dark silver surface and the deposition of a substantially uniform layer of molybdenum 1 micron thick of uniform density.

As shown in FIG. 18 an SEM/EPMA scan across the interface between the substrate and the applied metal shows molybdenum was present to a depth of at least 10 microns and a molybdenum gradient as set out below in Table.

TABLE

| DEPTH um | ELEMENT | CONCENTRATION (WT %) |
|---|---|---|
| 0.5 | Mo | 81.0 |
| | Fe | 19.0 |
| 2 | Mo | 2.2 |
| | Fe | 97.8 |
| 3 | Mo | 0.8 |
| | Fe | 99.2 |
| 10 | Mo | 0.6 |
| | Fe | 99.4 |

EXAMPLE VII

An aqueous solution of the following formulation was prepared:

| NAME | GRAM/LITER |
|---|---|
| Sodium Tungstate | 31.40 |
| Ferric Ammonium Sulphate | 8.63 |
| Ferrous Sulphate | 4.98 |
| Citric Acid | 66.00 |
| Water (distilled) | 1000 ml |
| Ammonium Hydroxide | to required pH |
| Sodium Lauryl Sulphate | 0.1 |
| Formaldehyde | 5 ml |

The solution had the following characteristics:

| | |
|---|---|
| pH = | 7.99 |
| Resistivity = | 22 ohms cm |
| $W^{+6}$ = | 1.75% by wt. |
| $Fe^{+2}$ = | 0.1% by wt. |
| $Fe^{+3}$ = | 0.1% by wt. |

The $W^{+6}$ concentration may vary from 1.6% to 2.5%; the pH may vary from 7.5 to 8.5; and the resistivity may vary from 18 ohms cm to 24 ohms cm.

Reaction Conditions

| | |
|---|---|
| Matrix = | Copper |
| Electrode = | Graphite |
| Cover = | Cotton gauze |
| Frequency = | 3.83 KHz |
| Rate of Application = | 689.4 mm/minute |
| Time of Application = | 3 minutes |

The sample showed a uniform deposit of tungsten approximately 1 micron thick. An SEM/EPMA scan showed fusion of tungsten on copper to a depth of at least 5.0 microns, as can be seen in the Table below and FIG. 19.

TABLE

| | CONCENTRATION (WT %) | | |
|---|---|---|---|
| DEPTH um | W | Fe | Cu |
| 1.0 | 37.3 | 38.5 | 24.2 |
| 2.0 | 4.8 | 2.1 | 93.1 |
| 3.0 | 0.5 | 0.3 | 99.2 |
| 4.0 | 0.7 | 0.2 | 99.1 |
| 5.0 | 0.3 | 0.2 | 99.5 |

EXAMPLE VIII

An aqueous solution of the following formulation was prepared:

| NAME | GRAMS/LITER |
|---|---|
| Sodium Tungsten | 34.00 |
| Ferrous Sulphate[1] | 4.98 |
| Ferrous Ammonium Sulphate[2] | 7.02 |
| Ferric Ammonium Sulphate | 8.62 |
| Citric Acid | 66.00 |
| Water (Distilled) | 980 |
| Ammonium Hydroxide | to required pH |
| Sodium Lauryl Sulphate | 0.10 |

NOTE: Either 1 or 2 may be employed

The solution had the following characteristics:

| | |
|---|---|
| pH = | 8 |
| Resistivity = | 20.9 ohms cm. |
| $W^{+6}$ = | 1.9% by wt. |
| $Fe^{+2}$ = | 0.1% by wt. |
| $Fe^{+3}$ = | 0.1% by wt. |

The concentration of tungsten may be varied from 1.6% to 2.5% by wt.; the pH from 7.5 to 8.5; and the conductivity from 18.8 ohms cm to 22.8 ohms cm.

Reaction Conditions

| | |
|---|---|
| Matrix = | Steel (ASA 1018) |
| Electrode = | Graphite |
| Electrode Cover = | Cotton gauze |
| Frequency = | 4.78 |
| Rate of Application = | 860.4 mm/minute |
| Time of Application = | 3 minutes |

An inspection of the sample by SEM/EPMA showed a deposit of tungsten of approximately 0.5 μm and as evident from FIG. 20 and the Table below tungsten was detected at a depth of at least 3 μm.

TABLE

| DEPTH um | ELEMENT | CONCENTRATION (WT %) |
|---|---|---|
| 0.5 | W | 52 |
| 1 | W | 6 |
| 2 | W | 1 |
| 3 | W | 1.1 |

EXAMPLE IX

An aqueous solution of the following formulation was prepared:

| NAME | GRAM/LITER |
|---|---|
| Indium Sulphate | 40.0 |
| Aluminium Sulphate | 9.6 |
| Sodium Sulphate | 3.5 |
| Gelatin | 0.05–0.1 |
| Sodium Lauryl Sulphate | 0.1–0.2 |
| Water (distilled) | 1000 ml. |

The solution had the following characteristics:

| | |
|---|---|
| pH = | 1.60 |
| Resistivity = | 51.8 ohms cm. |
| Concentration $In^{+3}$ = | 1.75% by wt. |

-continued

| | |
|---|---|
| Concentration $Al^{+3}$ = | 0.077 by wt. |

The Indium concentration may vary from 0.2% to 2.2%; the pH from 1.60 to 1.68; and the resistivity from 48.8 ohms cm to 54.8 ohms cm.

Reaction Conditions

| | |
|---|---|
| Matrix = | Copper |
| Electrode = | Graphite |
| Electrode Cover = | Cotton gauze |
| Frequency = | 4.75 |
| Rate of Application = | 855 mm/minute |
| Time of Application = | 3 minutes |

An examination of the sample under the optical microscope and the scanning electron microscope showed a continuous surface free from structural faults As shown in the following Table and FIG. 21 and an SEM/EPMA scan across the interface between the copper matrix and the indium layer showed a deposit of approximately 1 μm and fusion of indium to a depth of at least 4 μm.

TABLE

| DEPTH um | ELEMENT | CONCENTRATION INDIUM (WT %) |
|---|---|---|
| 1 | In | 90.3 |
| 2 | In | 5.5 |
| 3 | In | 4.3 |
| 4 | In | 3.6 |

EXAMPLE X

The solution of Example IX was employed and applied to a steel matrix:

Reaction Conditions

| | |
|---|---|
| Matrix = | Steel (ASA 1010) |
| Electrode = | Platinum |
| Electrode Cover = | Woven nylon |
| Frequency = | 6.29 KHz |
| Rate of Application = | 1132.2 mm/minute |
| Time of Application = | 3 minutes |

An even continuous layer of Indium approximately 1 μm thick was deposited on the surface of the matrix. An SEM/EPMA scan, FIG. 22 across the interface and the Table below indicated fusion to a depth of at least 3 μm:

TABLE

| DEPTH um | In (Wt %) | Fe (Wt %) |
|---|---|---|
| 0.5 | 91.4 | 8.6 |
| 1.0 | 5.2 | 94.8 |
| 2.0 | 1.0 | 99.0 |
| 3.0 | 0.9 | 99.1 |

A solid deposit of nickel of uniform density approximately 1.5 μm thick was also created. As shown in the following Table and FIG. 23 an SEM/EPMA scan across the interface between the matrix and the nickel layer shows nickel to be fused to a depth of at least 4 μm.

| DEPTH um | ELEMENT | WT % |
|---|---|---|
| 1 | Ni | 92.6 |
| 2 | Ni | 4.5 |
| 3 | Ni | 3.3 |
| 4 | Ni | 1.0 |

EXAMPLE XI

An aqueous solution of the following formulation was prepared:

| NAME | GRAM/LITER |
|---|---|
| Nickelous Sulphate | 248.9 |
| Nickelous Chloride | 37.3 |
| Boric Acid | 24.9 |
| Formaldehyde | 3 ml/liter |
| Benzene Sulphonic Acid | 10 ml/liter |
| Sodium Lauryl Sulphate | 0.1 |
| Water (distilled) | 900 |

The solution had the following characteristics:

| | |
|---|---|
| ph = | 3.10 |
| Resistivity = | 22.5 ohms cm. |
| Concentration of $Ni^{+2}$ = | 6% by wt. |

The nickel concentration may vary from 2% to 10%; pH from 3.10 to 3.50; and resistivity from 17 ohms cm to 26 ohms cm.

Reaction Conditions

| | |
|---|---|
| Matrix = | Copper |
| Electrode = | Graphite |
| Electrode Cover = | Cotton gauze |
| Frequency = | 7.50 KHz |
| Rate of Application = | 1350 mm/minute |
| Time of Application = | 3 minutes |

EXAMPLE XII

The same solution as was formulated for Example XI was prepared and applied to a steel matrix:

Reaction Conditions

| | |
|---|---|
| Matrix = | Steel ASA (1018) |
| Electrode = | Graphite |
| Electrode Cover = | Cotton gauze |
| Frequency = | 7.50 KHz |
| Rate of Application = | 1350 mm/minute |
| Time of Application = | 3 min. |

The nickel layer was created continuous and substantially uniform in thickness being about 1.5 μm thick.

As shown in FIG. 24 and in the following Table nickel is shown to be fused to a depth of at least 3 μm.

| DEPTH um | ELEMENT | CONCENTRATION (Wt %) |
|---|---|---|
| 1 | Ni | 95.9 |
| 2 | Ni | 28.0 |
| 3 | Ni | 0.7 |

EXAMPLE XIII

An aqueous solution of the following formulation was prepared:

| NAME | GRAMS/LITER |
|---|---|
| Chloroauric acid | 2.5 |
| Potassium ferrocyanide | 15.0 |
| Potassium carbonate | 15.0 |
| Water (distilled) | 1000 ml |

This solution had the following characteristics:

| | |
|---|---|
| pH = | 10.99 |
| Resistivity = | 40 ohms cm. |
| Concentration of = | .14% by wt. |

The pH may be varied from 3.70 to 11; the concentration of $Au^{+3}$ ions may vary from 0.1% to 0.5% by weight; and the resistivity from 40 ohms cm to 72 ohms cm.

Reaction Conditions

| | |
|---|---|
| MATRIX = | Copper |
| ELECTRODE = | Platinum |
| ELECTRODE COVER = | Cotton gauze |
| FREQUENCY = | 4.33 KHz |
| RATE OF APPLICATION = | 779.4 mm/minute |
| TIME OF APPLICATION = | 2 minutes |

Observation with the optical and scanning electron microscope revealed a surface deposition of gold approximately 1.5 μm thick. The deposit was continuous and uniformly dense.

An SEM/EPMA scan across the interface indicated fusion of gold to a depth of at least 3 μm as shown on the Table below and FIG. 25.

| DEPTH (um) | ELEMENT | CONCENTRATION (Wt %) |
|---|---|---|
| 0.5 | Au | 61.3 |
| 1.0 | Au | 9.6 |
| 2.0 | Au | 0.9 |
| 3.0 | Au | 0.5 |

EXAMPLE XIV

An aqueous solution of the same formulation as that of Example XIII was prepared:

Reaction Conditions

| | |
|---|---|
| MATRIX = | Steel |
| ELECTRODE = | Graphite |
| ELECTRODE COVER = | Cotton gauze |
| FREQUENCY = | 3.95 KHz |
| RATE OF APPLICATION = | 711.0 mm/minute |
| TIME OF APPLICATION = | 2.0 minutes |

Observation with the optical and scanning electron microscope revealed a surface deposition of gold approximately 1.0 μm thick. The deposit was uniformly thick and dense.

An SEM/EPMA scan across the interface indicated fusion of gold to a depth of at least 4.0 μm as shown on the table below and FIG. 26.

| DEPTH um | ELEMENT | CONCENTRATION (Wt %) |
|---|---|---|
| 0.5 | Au | 84.9 |
| 1.5 | Au | 10.6 |
| 2.0 | Au | 2.1 |
| 3.0 | Au | 0.8 |
| 4.0 | Au | 0.6 |

EXAMPLE XV

An aqueous solution of the following formulation was prepared:

| NAME | GRAMS/LITER |
|---|---|
| Chromium Trioxide | 150 |
| Chromium Sulphate | 0.06 |
| Sulphuric Acid | 2.15 |
| Sodium Silico Fluoride | 0.2 |
| Carbon Disulfide | 2-3 ml |
| Sodium Lauryl Sulphate | 0.05 |
| Water (distilled) | to 1000 ml |

This solution had the following characteristics:

| | |
|---|---|
| pH = | 0.6 |
| Resistivity = | 12 ohms cm |
| Concentration of $Cr^{+6}$ = | 7.8% by wt. |

The pH may be varied from 0.6 to 1.0; the concentration of $Cr^{+6}$ ions may vary from 3% to 20% by weight; and the resistivity from 11 ohms cm to 14 ohms cm.

Reaction Conditions

| | |
|---|---|
| MATRIX = | Copper |
| ELECTRODE = | Graphite |
| ELECTRODE COVER = | Cotton gauze |
| FREQUENCY = | 6.25 KHz |
| RATE OF APPLICATION = | 1125 mm/minute |
| TIME OF APPLICATION = | 5.0 minutes |

Observation with the optical and scanning electron microscope revealed a surface deposition of chromium approximately 1 μm thick. The surface of the layer was irregular but the deposit appeared free of faults and was continuous.

An SEM/EPMA scan across the interface indicated fusion of chromium to a depth of at least 3.0 μm as shown on the table below and FIG. 27.

| DEPTH um | ELEMENT | CONCENTRATION (Wt %) |
|---|---|---|
| 0.5 | Cr | 94.0 |
| 1.0 | Cr | 32.0 |
| 2.0 | Cr | 1.8 |
| 3.0 | Cr | 1.0 |

EXAMPLE XVI

An aqueous solution of the same formulation as employed in Example XV was prepared:

Reaction Conditions

| | |
|---|---|
| MATRIX = | Steel (ASA 1018) |
| ELECTRODE = | Graphite |
| ELECTRODE COVER = | Cotton gauze |
| FREQUENCY = | 6.48 KHz |

-continued

| | |
|---|---|
| RATE OF APPLICATION = | 1166.4 mm/minute |
| TIME OF APPLICATION = | 5.0 minutes |

Observation with the optical and scanning electrode microscope revealed a surface deposition of chromium approximately 3.0 μm thick.

Figure 28:
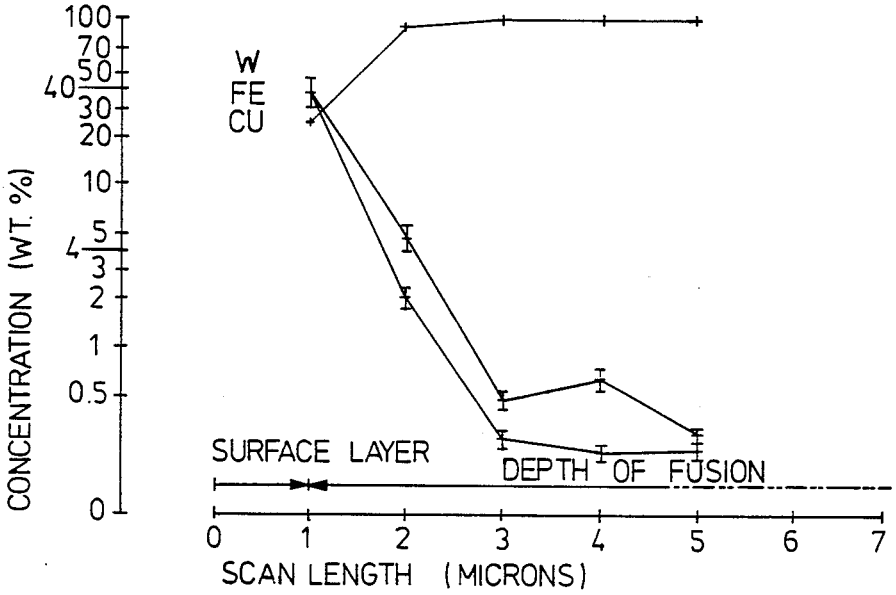
FIG. 28 is a graph of an SEM/EPMA scan across a steel matrix with which chromium has been fused using the process of the present invention with the first chromium solution referred to above and shows the fusion of chromium with steel.
Figure 48:
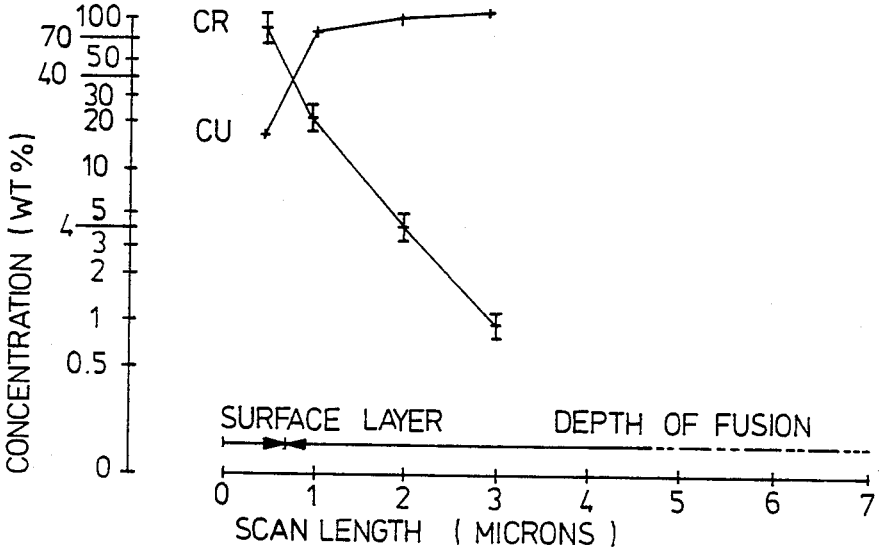
Figure 50:
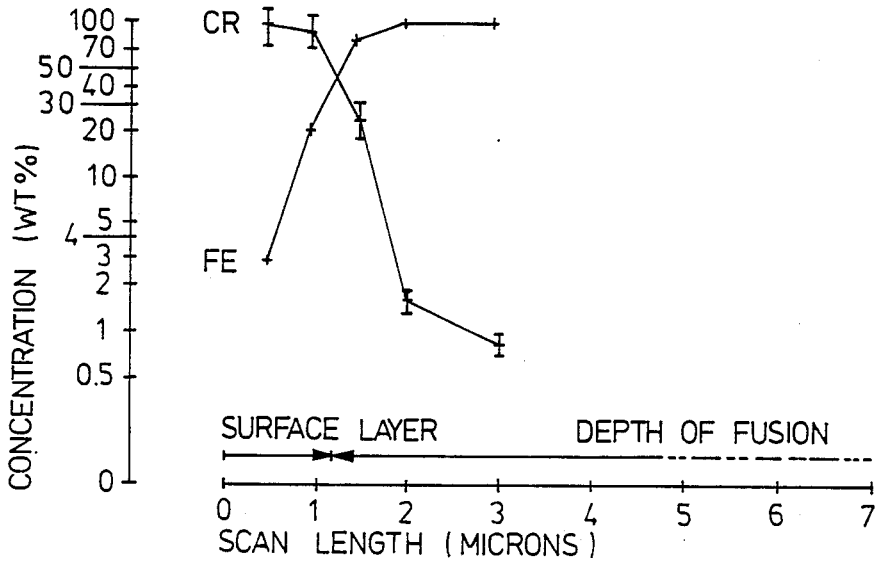
Figure 64:
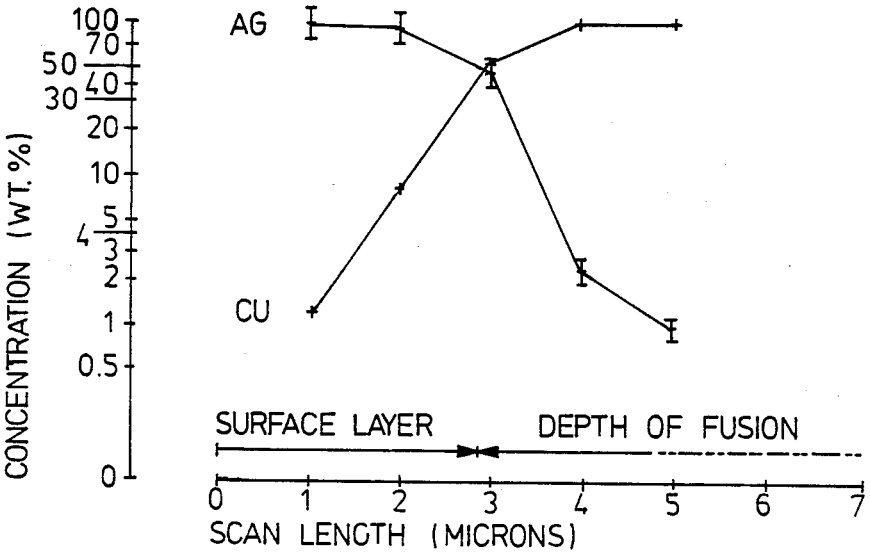

An SEM/EPMA scan across the interface indicated fusion of chromium to a depth of at least 5.0 μm as shown on the table below and FIG. 28.

| DEPTH um | ELEMENT | WT % |
|---|---|---|
| 1.0 | Cr | 100 |
| 2.0 | Cr | 97.2 |
| 3.0 | Cr | 20.8 |
| 4.0 | Cr | 2.8 |
| 5.0 | Cr | 2.1 |

EXAMPLE XVII

An aqueous solution of the following formulation was prepared:

| NAME | GRAMS/LITER |
|---|---|
| Chromic Chloride | 213 |
| Sodium Chloride | 36 |
| Ammonium Chloride | 26 |
| Boric Acid | 20 |
| Dimethyl Formamide | 400 ml |
| Sodium Acetate | 3.0 |
| Sodium Lauryl Sulphate | 0.5 |
| Water (distilled) | to 1000 ml. |

This solution had the following characteristics:

| | |
|---|---|
| pH = | 3.0 |
| Resistivity = | 17.4 ohms cm. |
| Concentration of $Cr^{+3}$ = | 2.5 to 3.5 |

The pH may be varied from 2.5 to 3.5; the concentration of $Cr^{+3}$ ions may vary from 1.8% to 5% by weight; and the resistivity from 16 ohms cm to 20 ohms cm.

Reaction Conditions

| | |
|---|---|
| MATRIX = | Copper |
| ELECTRODE = | Graphite |
| ELECTRODE COVER = | Cotton gauze |
| FREQUENCY = | 6.85 KHz |
| RATE OF APPLICATION = | 1251 mm/minute |
| TIME OF APPLICATION = | 3.0 minutes |

Observation with the optical and scanning electron microscope revealed a surface deposition of chromium approximately 0.5 μm thick. The deposit was solid and continuous.

An SEM/EPMA scan across the interface indicated fusion of chromium to a depth of at least 3.0 μm as shown on the Table below and FIG. 29.

| DEPTH um | ELEMENT | CONCENTRATION (Wt %) |
|---|---|---|
| 1 | Cr | 21.2 |
| 2 | Cr | 4.0 |
| 3 | Cr | 0.9 |

EXAMPLE XVIII

An aqueous solution of the same formulation as prepared for Example XVII was employed:

Reaction Conditions

| | |
|---|---|
| MATRIX = | Steel (ASA 1018) |
| ELECTRODE = | Graphite |
| ELECTRODE COVER = | Cotton gauze |
| FREQUENCY = | 6.85 KHz |
| RATE OF APPLICATION = | 1251 mm/minute |
| TIME OF APPLICATION = | 3.0 minutes |

Observation with the optical and scanning electron microscope revealed a surface deposition of chromium approximately 1.0 μm thick. The surface of the deposit appeared slightly irregular but the deposit was solid and free of faults.

An SEM/EPMA scan across the interface indicated fusion of chromium to a depth of at least 3.0 μm as shown on the table below and FIG. 30.

| DEPTH um | ELEMENT | CONCENTRATION (Wt %) |
|---|---|---|
| 0.5 | Cr | 97.2 |
| 1.0 | Cr | 97.6 |
| 1.5 | Cr | 22.2 |
| 2.0 | Cr | 1.5 |
| 3.0 | Cr | 0.8 |

EXAMPLE XIX

An aqueous solution of the following formulation was prepared:

| NAME | GRAMS/LITER |
|---|---|
| Cadmium Chloride | 6.74 |
| Tetrasodium Pyrophosphate | 54 |
| Water (distilled) | 1000 ml. |

This solution had the following characteristics:

| | |
|---|---|
| pH = | 10 |
| Resistivity = | 33 ohms cm. |
| Concentration of $Cd^{+2}$ = | 0.32% by wt. |

The pH may be varied from 10 to 10.2; the concentration of $Cd^{+2}$ ions may vary from 0.2% to 0.5% by weight; and the resistivity from 28 ohms cm to 35 ohms cm.

Reaction Conditions

| | |
|---|---|
| MATRIX = | Copper |
| ELECTRODE = | Graphite |
| ELECTRODE COVER = | Cotton gauze |
| FREQUENCY = | (1) 7.29 KHz; (2) 7.91 KHz |
| RATE OF APPLICATION = | (1) 1312.2 mm/min; (2) 1423.8 mm/min. |
| TIME OF APPLICATION = | (1) 1.0 min; (2) 3.0 min. |

In this Example the solution employed was initially as set out above, applied in accordance with the conditions identified as (1). A second solution, that set forth in Example XX, was then applied under the conditions identified as (2).

Observation with the optical and scanning electron microscope revealed a surface deposition of cadmium approximately 4 μm thick. This deposit was not homogenous, an SEM/EPMA scan across the interface indicated fusion of cadmium to a depth of at least 9 μm as shown on the Table below and FIG. 32.

| DEPTH um | ELEMENT | CONCENTRATION (Wt %) |
|---|---|---|
| 2 | Cd | 77.4 |
| 3 | Cd | 65.2 |
| 4 | Cd | 6.7 |
| 5 | Cd | 1.2 |
| 6 | Cd | 0.48 |
| 7 | Cd | 2.1 |
| 8 | Cd | 2.9 |
| 9 | Cd | 0.89 |

EXAMPLE XX

An aqueous solution of the following formulation was prepared:

| NAME | GRAMS/LITER |
|---|---|
| Cadmium Sulphate | 26.65 |
| Sodium Chloride | 8.7 |
| Boric Acid | 15.0 |
| Aluminium Sulphate | 17.5 |
| Acacia (Gum Arabic) | 0.25 |
| Sodium Tetraborate | 5.0 |
| Benzene Sulphonic Acid | 2.5 |
| Sodium Lauryl Sulphate | 0.5 |
| Water (distilled) | 1000 ml |

This solution had the following characteristics:

| | |
|---|---|
| pH = | 3.40 |
| Resistivity | 54 ohms cm. |
| Concentration of $Cd^{+2}$ = | 1.1% |

The pH may be varied from 3.2 to 3.5; the concentration of $Cd^{+2}$ ions may vary from 1% to 4% by weight; and the resistivity from 45 ohms cm to 55 ohms cm.

Reaction Conditions

| | |
|---|---|
| MATRIX = | Steel |
| ELECTRODE = | Platinum |
| ELECTRODE COVER = | Nylon cloth |
| FREQUENCY = | 13.7 KHz |
| RATE OF APPLICATION = | 2466 mm/minute |
| TIME OF APPLICATION = | 2 minutes |

Observation with optical and scanning electron microscope revealed a surface deposition of cadmium approximately 1 μm thick. The surfce of the deposit was irregular but it was solid and continuous.

An SEM/EPMA scan across the interface indicated fusion of cadmium to a depth of at least 4 μm as shown on the Table below and FIG. 32.

| DEPTH um | ELEMENT | CONCENTRATION (Wt %) |
|---|---|---|
| 0.5 | Cd | 73.3 |
| 1.0 | Cd | 8.8 |
| 2.0 | Cd | 1.4 |
| 3.0 | Cd | 1.2 |
| 4.0 | Cd | 1.1 |

EXAMPLE XXI

An aqueous solution of the following formulation was prepared:

| NAME | GRAMS/LITER |
|---|---|
| Stannous chloride | 77.3 |
| Sodium hydroxide | 66.0 |
| Sodium acetate | 14.7 |
| Water (distilled) | 1000 ml. |

This solution had the following characteristics:

| | |
|---|---|
| pH = | 12.4 |
| Resistivity = | 8.6 ohms cm. |
| Concentration of $Sn^{+2}$ ions = | 4% by weight |

The pH may be varied from 11.2 to 12.7; the concentration of $Sn^{+2}$ ions may vary from 2% to 5% by weight; and the resistivity from 6.2 ohms cm to 10.3 ohms cm.

Reaction Conditions

| | |
|---|---|
| MATRIX = | Copper |
| ELECTRODE = | Graphite |
| ELECTRODE COVER = | Cotton gauze |
| FREQUENCY = | 9.85 KHz |
| RATE OF APPLICATION = | 1773 mm/minute |
| TIME OF APPLICATION = | 2 minutes |

Observation with the optical and scanning electron microscope revealed a surface deposition of tin approximately 1.2 μm thick. The deposit was uniformly thick and homogenous.

An SEM/EPMA scan across the interface indicated fusion of tin to a depth of at least 4 μm as shown on the table below and FIG. 33.

| DEPTH um | ELEMENT | CONCENTRATION (Wt %) |
|---|---|---|
| 1 | Sn | 91.4 |
| 2 | Sn | 4.4 |
| 3 | Sn | 0.9 |
| 4 | Sn | 0.5 |

EXAMPLE XXII

An aqueous solution of the following formulation was prepared:

| NAME | GRAMS/LITER |
|---|---|
| Stannous chloride | 9.4 |
| Tetrasodium pyrophosphate | 44.7 |
| Dextrine | 6.25 |
| Water (distilled) | 1000 ml |
| Sodium lauryl sulphate | 0.5 |

This solution had the following characteristics:

| | |
|---|---|
| pH = | 9.05 |
| Resistivity = | 34 ohms cm. |
| Concentration of $Sn^{+2}$ = | 0.50% by weight |

The pH may be varied from 9 to 9.7; the concentration of $Sn^{+2}$ ions may vary from 0.4% to 1% by weight; and the resistivity from 30 ohms cm to 36 ohms cm.

Reaction Conditions

| | |
|---|---|
| MATRIX = | Copper |
| ELECTRODE = | Graphite |
| ELECTRODE COVER = | Cotton gauze |
| FREQUENCY = | 9.85 KHz |
| RATE OF APPLICATION = | 1773 mm/minute |
| TIME OF APPLICATION = | 2 minutes |

Observation with the optical and scanning electron microscope revealed a surface deposition of tin approximately 4 μm thick. This deposit appears to comprise a lower uniform and substantially homogenous layer of approximately 1 μm thick and an outer slightly porous layer approximately 3 μm thick.

An SEM/EPMA scan across the interface indicated fusion of tin to a depth of at least 5 μm as shown on the Table below and FIG. 35.

| DEPTH um | ELEMENT | CONCENTRATION (Wt %) |
|---|---|---|
| 1 | Sn | 97 |
| 2 | Sn | 97.3 |
| 3 | Sn | 94.3 |
| 5 | Sn | 1.0 |

EXAMPLE XXIII

An aqueous solution of the same as prepared for Example XXII was employed:

Reaction Conditions

| | |
|---|---|
| MATRIX = | Steel (ASA 1010) |
| ELECTRODE = | Graphite |
| ELECTRODE COVER = | Cotton gauze |
| FREQUENCY = | 10.61 KHz |
| RATE OF APPLICATION = | 1909.8 mm/minute |
| TIME OF APPLICATION = | 3 minutes |

Observation with the optical and scanning electron microscope revealed a surface deposition of tin exceeding 2 μm thick. This layer was porous but continuous.

An SEM/EPMA scan across the interface indicated fusion of tin to a depth of at least 2 μm as shown on the table below and FIG. 35.

| DEPTH um | ELEMENT | WT % |
|---|---|---|
| 0.5 | Sn | 96.2 |
| 1.0 | Sn | 81.4 |
| 2.0 | Sn | 2.5 |

EXAMPLE XXIV

An aqueous solution of the following formulation was prepared:

| NAME | GRAMS/LITER |
|---|---|
| Cobaltous sulphate | 252 |
| Sodium fluoride | 14 |
| Boric acid | 45 |
| Dextrose | 5 |
| Sodium lauryl sulphate | 0.2 |
| Water (distilled) | 1000 ml |

This solution had the following characteristics:

| | |
|---|---|
| pH = | 6.03 |
| Resistivity = | 28.5 ohms cm. |
| Concentration of $Co^{+2}$ = | 5.3% by wt. |

The pH may be varied from 4.5 to 6.5; the concentration of $Co^{+2}$ ions may vary from 2% to 6% by weight; and the resistivity from 25 ohms cm to 30 ohms cm.

Reaction Conditions

| | |
|---|---|
| MATRIX = | Copper |
| ELECTRODE = | Platinum |
| ELECTRODE COVER = | Nylon mesh |
| FREQUENCY = | 5.1 KHz |
| RATE OF APPLICATION = | 918 mm/minute |
| TIME OF APPLICATION = | 3.0 minutes |

Observation with the optical and scanning electron microscope revealed a surface deposition of cobalt approximately 6.5 μm thick. This layer was uniform and continuous.

An SEM/EPMA scan across the interface indicated fusion of cobalt to a depth of at least 20 μm as shown on the Table below and FIG. 35.

| DEPTH um | ELEMENT | CONCENTRATION (Wt %) |
|---|---|---|
| 10 | Co | 2.65 |
| 15 | Co | 1.6 |
| 20 | Co | 0.87 |
| 25 | Co | 0.44 |

It was evident by visual inspection and from the previous experiments that the deposit of cobalt was above the 10 μm level was extremely dense.

EXAMPLE XXV

An aqueous solution of the following formulation was prepared:

| NAME | GRAMS/LITER |
|---|---|
| Silver cyanide | 26 |
| Potassium cyanide | 46 |
| Potassium carbonate | 37 |
| Sodium lauryl sulphate | 1 |
| Carbon disulphide | 1-2 |
| Water (distilled) | 1000 ml. |

This solution had the following characteristics:

| | |
|---|---|
| pH = | 11.55 |
| Resistivity = | 10.5 ohms cm. |
| Concentration of $Ag^{+1}$ = | 2.09% by wt. |

The pH may be varied from 11.2 to 11.7; the concentration of $Ag^{+1}$ ions may vary from 1% to 3% by weight; and the resistivity from 8 ohms cm to 13 ohms cm.

Reaction Conditions

| | |
|---|---|
| MATRIX = | Copper |
| ELECTRODE = | Platinum |
| ELECTRODE COVER = | Nylon |
| FREQUENCY = | 7.7 KHz. |
| RATE OF APPLICATION = | 1386 mm/minute |
| TIME OF APPLICATION = | 1.0 minute |

Observation with the optical and scanning electron microscope revealed a surface deposition of silver approximately 5 μm thick.

An SEM/EPMA scan across the interface indicated fusion of silver to a depth of at least 3 μm as shown on the Table below and FIG. 37.

| DEPTH um | ELEMENT | CONCENTRATION (Wt. %) |
|---|---|---|
| 1 | Ag | 98.7 |
| 2 | Ag | 91.4 |
| 3 | Ag | 46.3 |
| 4 | Ag | 2.4 |
| 5 | Ag | 1.0 |

EXAMPLE XXVI

An aqueous solution of the following formulation was prepared:

| NAME | GRAMS/LITER |
|---|---|
| Silver nitrate | 29 |
| Potassium iodide | 398 |
| Citric acid | 6 |
| Dextrose | 5 |
| Carbon disulfide | 1.5 |
| Ammonium hydroxide | to pH |
| Water (distilled) | 1000 ml. |

This solution had the following characteristics:

| | |
|---|---|
| pH = | 5.6 |
| Resistivity = | 6.6 ohms cm. |
| Concentration of $Ag^{+1}$ = | 1.84% |

The pH may be varied from 1.5 to 2; the concentration of $Ag^{+1}$ ions may vary from 0.5% to 2.5% by weight; and the resistivity from 6 ohms cm to 12 ohms cm.

Reaction Conditions

| | |
|---|---|
| MATRIX = | Copper |
| ELECTRODE = | Graphite |
| ELECTRODE COVER = | Cotton gauze |
| FREQUENCY = | 9.5 KHz. |
| RATE OF APPLICATION = | 1710 mm/minute |
| TIME OF APPLICATION = | 2.0 minutes |

Observation with the optical and scanning electron microscope revealed a surface deposition of silver approximately 2 μm thick.

An SEM/EPMA scan across the interface indicated fusion of silver to a depth of at least 2.00 μm as shown on the Table below and FIG. 38.

| DEPTH um | ELEMENT | CONCENTRATION (Wt %) |
|---|---|---|
| 1 | Ag | 97.7 |
| 2 | Ag | 97.5 |
| 3 | Ag | 28.0 |
| 4 | Ag | 3.8 |
| 5 | Ag | 2.8 |
| 6 | Ag | 1.0 |

From the foregoing Examples it will be seen that the present application discloses a novel process, apparatus for carrying out the process, solutions for use in the process, and new products which are capable of a wide variety of applications and uses.

it is also to be noted that while the description has been with respect to Examples in which the application was across the entire surfaces it is quite evident that the application may be limited to specific areas of surfaces depending to give a specific desired result.

For example tin, gold and silver, with their inherent excellent conductivity characteristics may be employed in electrical applications and circuits may be fused on other substrates.

The anti-corrosion characteristics of tin, gold, silver, nickel, chromium, molybdenum and tungsten are also useful. And the application of those metals to ferrous or non-ferrous substrates will enhance their anti-corrosion behaviour.

Chromium, nickel, silver, gold or tin have the capability of imparting an elegant appearance to the matrix. Chromium, molybdenum, tungsten, titanium and cobalt impart a surface hardness to the matrix.

Indium imparts strength to the matrix, and also serves as anti-galling agent. A molybdenum treated ferrous or non-ferrous matrix has improved friction-wear and high temperature resistance characteristics. It is also useful as a dielectric coating.

A cadmium fused matrix as well as having enhanced corrosion resistance characteristics can also serve as an anti-fouling agent for ship hull treatment.

Silver fused matrices are all useful as a deflecting medium.

It will be apparent that the process and apparatus are extremely facile to use without large capital expenditure and plant and permit the use of materials in applications which were not heretofore contemplated at less expense than previously and apart from the applications and uses specified many others will be apparent to those skilled in the art.

It will also be apparent that the various parameters in the process may be varied depending on the variables which may be encountered and the results required without departing from the spirit and scope of the invention as defined in the claims annexed.

The embodiment of the invention in which an exclusive property or privilege is claimed are defined as follows:

1. A process for the fusion, at an ambient temperature, of at least one second conductive chemical element into a matrix of a first conductive chemical element which comprises:

placing said second conductive element in contact with an adjacent surface of said first conductive chemical element; and applying an interrupted electrical signal of a predetermined frequency to said first and second chemical elements, whereby said second chemical element is fused with said first chemical element, said signal being a pulsing signal in the range of 2.5 microseconds to 28.6 nanoseconds with an amplitude in the range of 3 amps per 0.3 square mm. for a predetermined period, said second conductive element being moved over said matrix at a rate sufficient to cause a substantially continuous area of fusion of said second conductive chemical element with said first chemical element and the rate of movement of said second conductive chemical element being substantially proportional to half the frequency of said electrical signal.

2. A process as claimed in claim 1 wherein said frequency is in the range of 400 Hz to 35 MHz.

3. A process as claimed in claim 1 wherein said first conductive chemical element is chosen from the group comprising ferrous or non-ferrous metals or an alloy thereof.

4. A process as claimed in claim 1 wherein said second conductive chemical element is chosen from the group comprising ferrous or non-ferrous metals or an alloy thereof.

5. A process as claimed in claim 1 wherein said first conductive chemical element is chosen from the group comprising ferrous metals or an alloy thereof and said second conductive element is chosen from the group comprising non-ferrous metals or an alloy thereof.

6. A process as claimed in claim 1 wherein said first conductive element is chosen from the group comprising non-ferrous metals or an alloy thereof and said second conductive element is chosen from the group comprising ferrous metals or an alloy thereof.

7. A process as claimed in claim 1 wherein said second conductive element is in the form of a solid electrode including said second conductive element.

* * * * *